US008983328B2

(12) United States Patent
Mizuta et al.

(10) Patent No.: US 8,983,328 B2
(45) Date of Patent: Mar. 17, 2015

(54) CONNECTOR FOR HEATER, FIXING APPARATUS AND IMAGE FORMING APPARATUS

(71) Applicant: Canon Kabushiki Kaisha, Tokyo (JP)

(72) Inventors: Takayuki Mizuta, Numazu (JP); Hideki Ohta, Numazu (JP); Atsuhiko Yamaguchi, Suntou-gun (JP); Yusuke Nakashima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/890,501

(22) Filed: May 9, 2013

(65) Prior Publication Data

US 2013/0336672 A1 Dec. 19, 2013

(30) Foreign Application Priority Data

May 10, 2012 (JP) ..... 2012-108115
Mar. 27, 2013 (JP) ..... 2013-066154

(51) Int. Cl.
*G03G 21/00* (2006.01)
*G03G 21/18* (2006.01)

(52) U.S. Cl.
CPC ..... *G03G 21/1867* (2013.01)
USPC ..... 399/75

(58) Field of Classification Search
CPC ..... G03G 15/50; G03G 15/55
See application file for complete search history.

(56) References Cited

U.S. PATENT DOCUMENTS

| | | | | |
|---|---|---|---|---|
| 5,828,035 | A * | 10/1998 | Kuroda | 219/216 |
| 6,056,590 | A * | 5/2000 | Takahashi et al. | 439/489 |
| 2009/0220288 | A1* | 9/2009 | Omata | 399/333 |
| 2011/0103808 | A1 | 5/2011 | Abe et al. | |
| 2011/0103809 | A1 | 5/2011 | Kuwata et al. | |
| 2012/0108113 | A1* | 5/2012 | Yamaguchi et al. | 439/842 |
| 2013/0108306 | A1 | 5/2013 | Saito et al. | |
| 2013/0195532 | A1 | 8/2013 | Abe et al. | |

* cited by examiner

*Primary Examiner* — Clayton E Laballe
*Assistant Examiner* — Frederick Wenderoth
(74) *Attorney, Agent, or Firm* — Fitzpatrick, Cella, Harper & Scinto

(57) ABSTRACT

An image fixing apparatus includes a heater including a substrate, a first electrode provided on one side of the substrate and a second electrode provided on the other side of the substrate; and a connector, connected with the heater, for receiving electric power, the connector including an electrically insulative housing, and a contact terminal provided inside the housing and having first spring contact contacted to the first electrode and a second spring contact contacted to the second electrode, wherein the first spring contact and the second spring contact are disposed at positions different as seen in a direction perpendicular to a surface of the substrate.

16 Claims, 20 Drawing Sheets

CONNECTOR FOR HEATER, FIXING APPARATUS AND IMAGE FORMING APPARATUS

FIELD OF THE INVENTION AND RELATED ART

The present invention relates to a connector for supplying a heater made up of a dielectric substrate and a heat generating member formed on the substrate, with electric power. It also relates to a fixing apparatus having such a connector.

A fixing apparatus having an endless belt and a ceramic heater which is in contact with the inward surface of the endless belt has been put to practical use as a fixing apparatus for thermally fixing a toner image formed on a sheet of recording medium, to the sheet of recording medium. A ceramic heater has a ceramic substrate, a heat generating member, and electrodes which are in electrical connection with the heat generating member. The heater is held by a heater holder. A connector for supplying the heater with electric power is connected to the electrodes of the heater. The connector is provided with a pair of contact terminals. In order to ensure that the contact terminals of the power supply connector remain satisfactorily connected with the electrodes of the heater, it is necessary for a preset amount of contact pressure to be maintained between the contact terminals of the power supply and the heater electrodes.

Some ceramic heaters are structured so that a heater (or heaters) is placed on both surfaces of their ceramic substrate. In the case of these ceramic heaters, therefore, it is possible that they may have an electrode (or electrodes) on both surfaces of their ceramic substrate (heater having a heater (or heaters) on both of its surfaces may be referred to simply as "two-sided heater"). Thus, a power supply connector for a ceramic heater having an electrode (or electrodes) on both surfaces of its ceramic substrate has to be structured so that as it is connected to (engaged with) the ceramic heater, the spring contacts of the power supply connector come into contact with the electrodes of the ceramic heater, on both surfaces of the ceramic heater. This structural arrangement for the power supply connector is problematic for the following reason:

That is, if a ceramic heater is reduced in the thickness of its ceramic substrate in order to reduce the heater in thermal capacity, for example, the amount by which the spring contacts of the power supply connector are bent when the connector is engaged with the ceramic heater (electrodes of ceramic heater), also reduces, making it difficult to provide the interface between the electrodes of the ceramic heater and the spring contacts of the power supply connector, with a satisfactory amount of contact pressure.

SUMMARY OF THE INVENTION

The present invention is made in consideration with the above described issue. Thus, the primary object of the present invention is to provide a fixing apparatus (device) and the connector therefor, which are capable of ensuring that the satisfactory electrical connection is maintained between the electrodes of the heater (ceramic heater, for example) of the fixing apparatus and the power supply connector for the heater of the fixing apparatus.

According to an aspect of the present invention, there is provided an image fixing device for heating and fixing an unfixed image formed on a recording material, comprising a heater including a substrate, a first electrode provided on one side of said substrate and a second electrode provided on the other side of the substrate; and a connector, connected with said heater, for receiving electric power, said connector including an electrically insulative housing, and a contact terminal provided inside said housing and having first spring contact contacted to said first electrode and a second spring contact contacted to said second electrode, wherein said first spring contact and said second spring contact are disposed at positions different as seen in a direction perpendicular to a surface of said substrate.

According to another aspect of the present invention, there is provided an electrical connector for electric power supply, said connector comprising electrically insulative housing; and a contact terminal provided inside said housing and including a first spring contact for contacting to a first electrode provided on one side of a heater substrate and a second spring contact for contacting to a second electrode provided on the other side of the substrate, wherein said first spring contact and said second spring contact are disposed at positions different from each other as seen in a direction perpendicular to a surface of said substrate.

According to a further aspect of the present invention, there is provided an image fixing apparatus for heating and fixing an unfixed image formed on a recording material, comprising a heater including a substrate, a first electrode provided on one side of said substrate and a second electrode provided on the other side of the substrate; and a connector, connected with said heater, for receiving electric power, said connector including an electrically insulative housing, a first contact terminal provided inside said housing and having first spring contact contacted to said first electrode, and a second contact terminal provided inside said housing and having a second spring contact contacted to said second electrode.

According to a further aspect of the present invention, there is provided an electrical connector for electric power supply, said connector comprising electrically insulative housing; and a first contact terminal provided inside said housing and including a first spring contact for contacting to a first electrode provided on one side of a heater substrate; and a second contact terminal provided inside said housing and including a second spring contact for contacting to a second electrode provided on the other side of the heater substrate.

Further features of the present invention will become apparent from the following description of exemplary embodiments (with reference to the attached drawings).

DESCRIPTION OF THE PREFERRED EMBODIMENTS

Hereinafter, embodiments of the present invention are described in detail with reference to the appended drawings.

<Embodiment 1>

(General Structure of Image Forming Apparatus)

Figure 21:
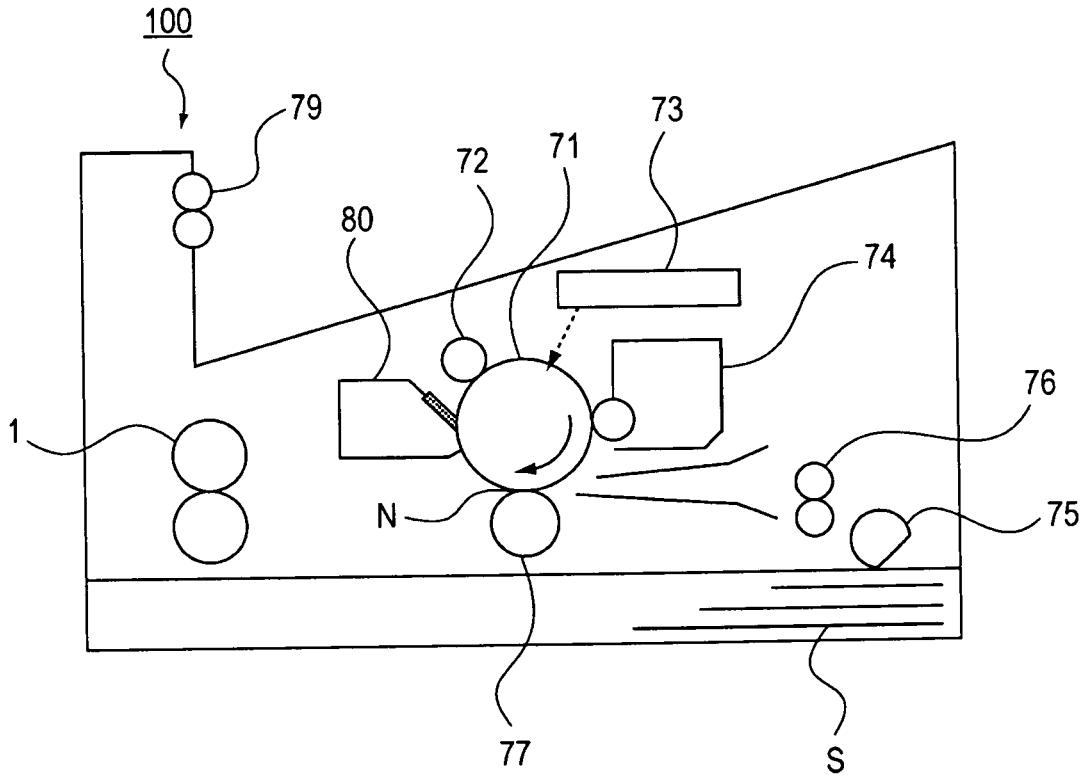
FIG. 21 is a schematic sectional view of a typical image forming apparatus with which the present invention is compatible.
Figure 22A:
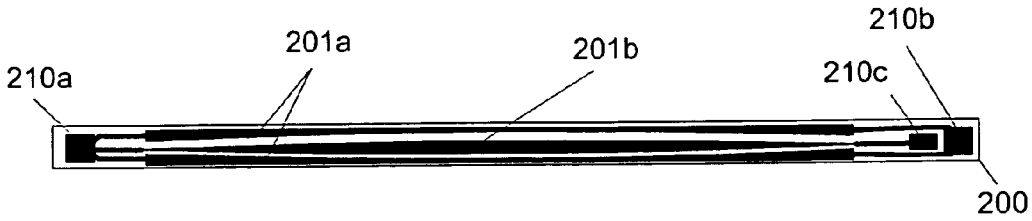
FIGS. 22A-22E are drawings for showing the structure of the ceramic heater and the power supply connector for the heater, in the fifth embodiment of the present invention.
Figure 22B:
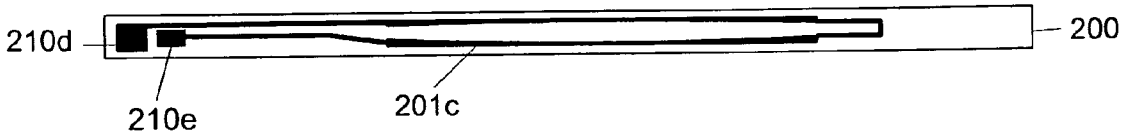
Figure 22C:
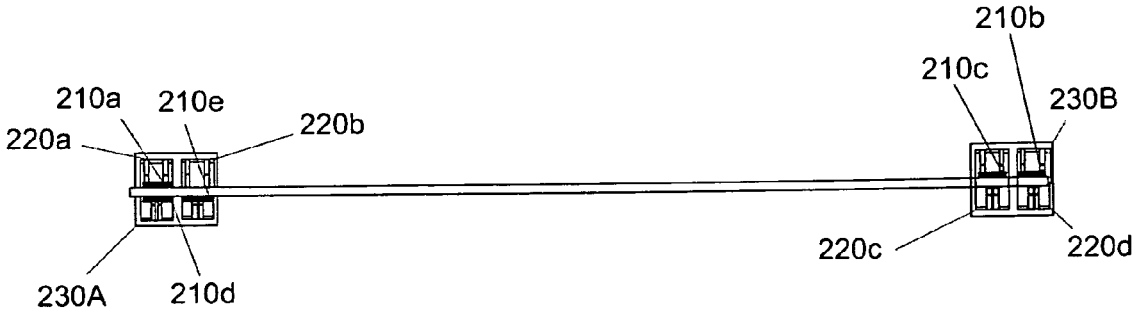
Figure 22D:
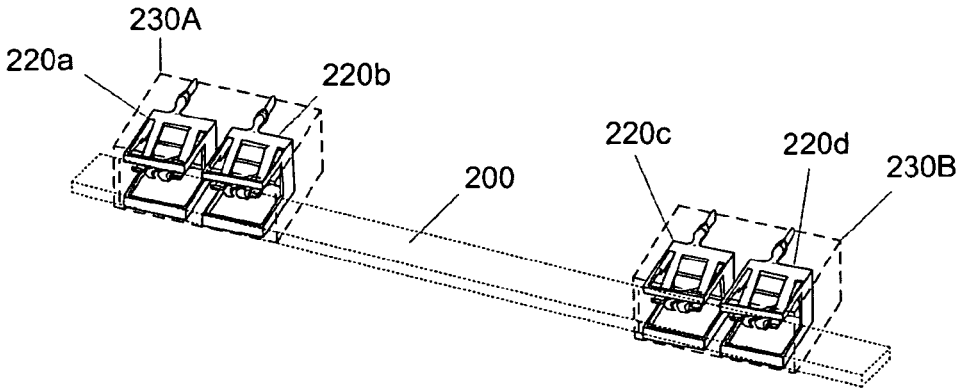
Figure 22E:
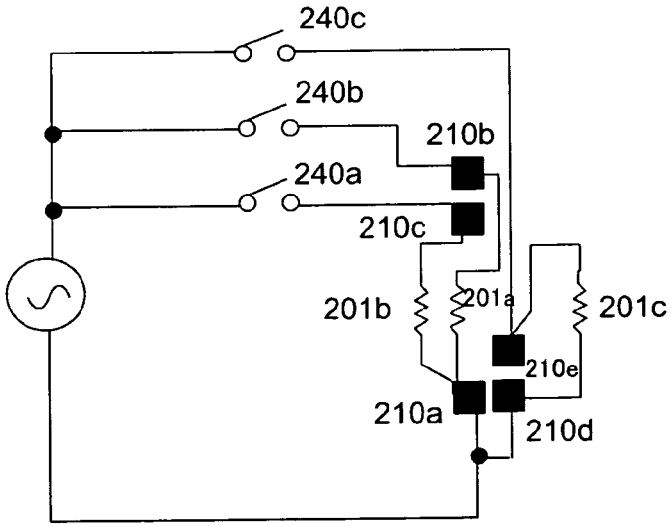

FIG. 21 is a drawing for showing the general structure of a typical image forming apparatus with which the present invention is compatible. This image forming apparatus is an electrophotographic printer.

The printer 100 receives the information of an image to be formed, from an external host computer or the like (unillustrated), and forms on a sheet S of recording medium, an image which is in accordance with the received information of the image to be formed.

As soon as the printer 100 receives a print signal, the photosensitive drum 71 of the printer 100 begins to be rotationally driven in the clockwise direction, at a preset peripheral velocity. While the photosensitive drum 71 is rotationally driven, its peripheral surface is charged to a preset potential level by the charge roller 72 of the printer 100, to which a preset bias is being applied.

Then, the charged portion of the peripheral surface of the photosensitive drum 71 is scanned (exposed) by the laser scanner 73 of the printer 100, in accordance with the information of the image to be formed, which was received from the unshown host computer or the like. As a result, an electrostatic latent image, which reflects the information of the image to be formed, is effected on the charged portion of the peripheral surface of the photosensitive drum 71. Then, the electrostatic latent image is developed by the developing device 74 of the printer 100, into a toner image, which is a visible image formed of toner, on the peripheral surface of the photosensitive drum 71.

Meanwhile, one of the sheets S of recording medium, which are in a sheet feeder cassette of the printer 100 is fed into the main assembly of the printer 100, by the sheet feeder roller 75 of the printer 100, while being separated from the rest in the cassette. Then, the sheet S is conveyed, with a preset control timing, by the pair of registration rollers 76 of the printer 100, to the transfer nip N which is formed between the photosensitive drum 71 and the transfer roller 77 of the printer 100. Then, while the sheet S is conveyed through the transfer nip N, remaining pinched by the transfer nip N, the toner image on the photosensitive drum 71 is transferred onto the sheet S as if it is peeled away from the photosensitive drum 71.

After the transfer of the toner image onto the sheet S, the sheet S is conveyed through the fixing device 1 of the printer 100. While the sheet S is conveyed through the fixing device 1, the toner image on the sheet S is thermally fixed to the sheet. Then, the sheet S is discharged from the printer 100 by the pair of discharge rollers 79 of the printer 100.

The transfer residual toner, that is, the toner remaining on the peripheral surface of the photosensitive drum 71 after the transfer of the toner image onto the sheet S, is removed by the cleaning device 80 of the printer 100, ending the image formation process sequence.

The photosensitive drum 71, charge roller 72, laser scanner 73, developing device 74, transfer roller 77, and cleaning device 80 make up the image forming means of the printer 100.

(Structure of Fixing Device)

Figure 1:
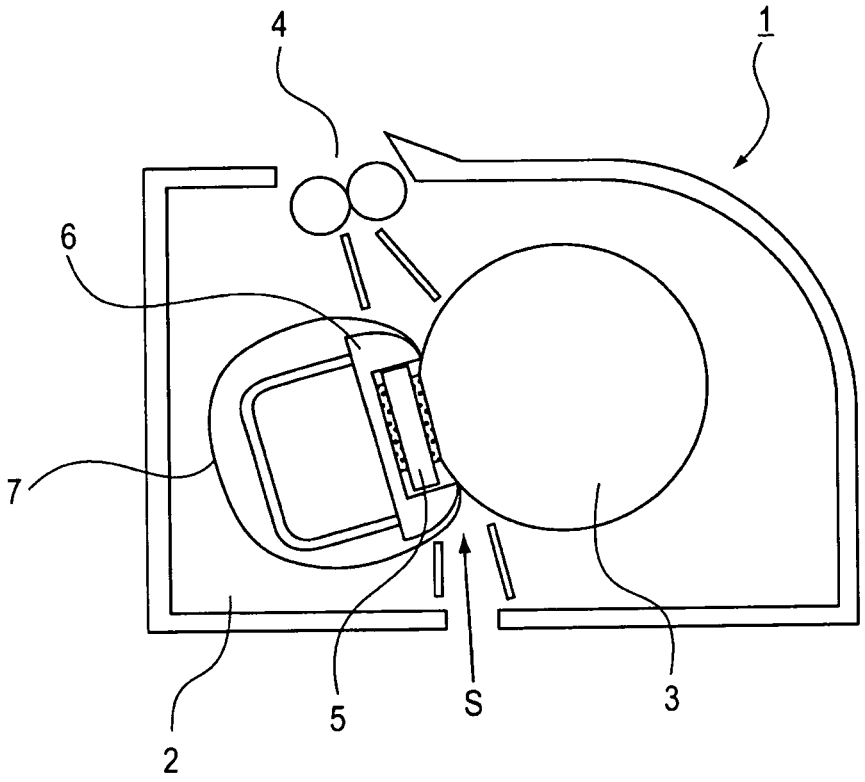
FIG. 1 is a sectional view of a typical fixing apparatus (device) to which the present invention is applicable.

Next, referring to FIG. 1, the general description of the fixing device 1 is given. FIG. 1 is a sectional view of the fixing device 1 in this embodiment.

The fixing device 1 is made up of a heating unit 2, a pressure roller 3, a pair of sheet conveyance rollers 4, a sheet guiding portion, and a housing. The heating unit 2 is made up of a heater 5, and a heater supporting member 6 (substrate holder). As the heater 5 is supplied with electric power, it generates heat. The heater 5 is kept pressed toward the pressure roller 3 by a pressure generating means (unshown). The pressure roller 3 rotates by being externally driven. The heating unit 2 has a cylindrical film 7 (endless belt), which is circularly moved by the rotation of the pressure roller 3. As the sheet S, on which an unfixed toner image is borne, is conveyed to the area of contact between the heating unit 2 and pressure roller 3, the toner in the unfixed toner is fixed to the sheet S, by the heat and pressure applied by the combination of the heating unit 2 and pressure roller 3. Thereafter, the sheet S is conveyed out of the fixing device 1, and is discharged into the delivery tray (unshown) of the printer 100, by the pair of sheet conveyance rollers 4 of the fixing device 1.

(Structure of Heating Unit)

Next, referring to FIGS. 2-5, the heating unit 2 in this embodiment is described.

Figure 2A:
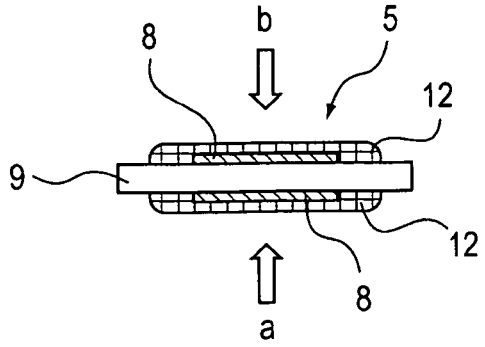
FIGS. 2A, 2B, and 2C are drawings for illustrating the structure of the heater in the first embodiment of the present invention.
Figure 2B:
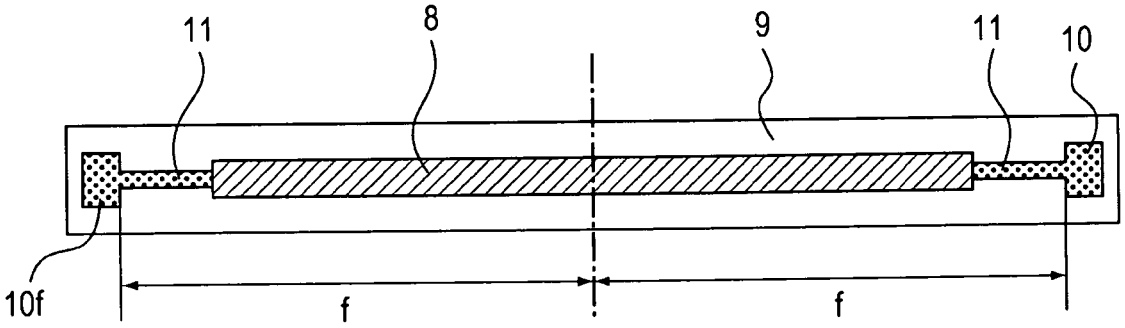
Figure 2C:
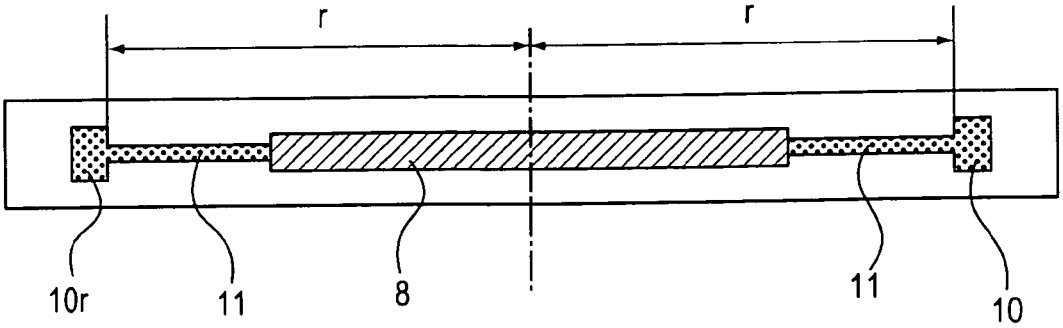

First, referring to FIG. 2, the general structure of the heater 5 is described. FIG. 2(*a*) is a sectional view of the heater 5. FIG. 2(*b*) is a plan view of the heater 5 as seen from the direction indicated by an arrow mark b in FIG. 2(*a*). It shows the surface (first surface) of the heater 5, which has a heat generating member 8, which is greater in dimension in terms of the lengthwise direction of the heater 5 than the heat generating member 8 on the other surface of the heater 5. FIG. 2(*c*) is a plan view of the heater 5 as seen from the direction indicated by an arrow mark a in FIG. 2(*a*). It shows the surface (second surface) of the heater 5, which has the heat generating member 8, which is less in dimension in terms of the lengthwise direction of the heater 5 than the heat generating member 8 on the first surface. The two surfaces shown in FIGS. 2(*b*) and 2(*b*), respectively, are parallel to each other.

The heater 5 has a dielectric substrate 9 made of ceramic material. The abovementioned heat generating member 8, which generates heat as electric current flows through it, is on the surface of this dielectric substrate 9. The heater 5 is also provided with electrodes 10, 10*f* and 10*r*, and leads 11. More specifically, the electrodes 10, 10*f* and 10*r* are for supplying the heat generating member 8 with electric power. Each of the leads 11 is in connection to one of the lengthwise ends of the heat generating member 8 and the corresponding the electrode to provide electrical connection between the electrode and heat generating member 8. The heater 5 is also provided with a protective layer 12 which is made of glass or the like substance, and is placed on the dielectric substrate, heat generating member 8, and leads 11, to protect the heat generating member 8 and leads 11. The combination of the electrodes 10 and 10*f* is on the first surface of the dielectric substrate 9, and the combination of the electrodes 10 and 10*r* is on the second surface of the dielectric substrate 9.

The heat generating member 8 on the first surface of the substrate 9 and the heat generating member 8 on the second surface of the substrate 9 are made different in dimension in terms of the lengthwise direction of the heater 5, in order to enable the heater 5 to accommodate various sheets which are different in size. As the heat generating member 8 is supplied with electric power through a connector 13 (which will be described later), electrodes 10, 10*f* and 10*r*, and the leads 11, each heat generating member 8 generates heat by the amount proportional to the amount of the supplied electric power. Thus, the amount by which heat is generated by the heater 5 can be controlled by controlling the amount of electric power supply to the heater 5, more specifically, by simultaneously supplying both heat generating members 8 with electric power, or supplying only one of the heating members 8 with electric power.

It is desired that the electrodes 10 and 10*f* to be grounded are positioned on the first surface of the substrate 9 in such a manner that they will be symmetrically positioned with reference to the center of a sheet S of recording medium, in terms of the direction perpendicular to the recording medium conveyance direction, when the sheet S is conveyed through the fixing device 1, and also, that the electrodes 10 and 10*r* to be grounded are positioned on the second surface of the substrate 9 in such a manner that they will be symmetrically positioned with reference to the center of the sheet S, in terms of the direction perpendicular to the recording medium conveyance direction. It is also desired that the heat generating members 8 are positioned on the first and second surfaces, one for one, of the substrate 9, in such a manner that the center of the heater 5, in terms of their lengthwise direction, coincides with the center of the sheet S in terms of the direction perpendicular to the recording medium conveyance direction when the sheet S is conveyed through the fixing device 1, for the following reason. That is, the electrodes 10, 10*f* and 10*r*, and the heat generating members 8 are positioned as described above to make the heat distribution of the heater 5 symmetrical with reference to the center of the sheet S in terms of the direction perpendicular to the recording medium conveyance direction (lengthwise direction of heater 5), in order to prevent the end portions of the heater 5 from excessively increasing in temperature.

Figure 3A:
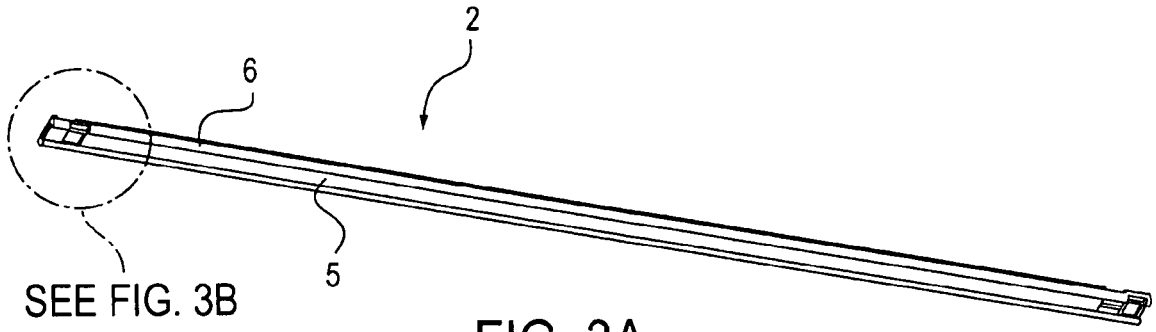
FIGS. 3A, 3B, and 3C are drawings for showing how the heater is supported by the heater supporting member, in the first embodiment of the present invention.
Figure 3B:
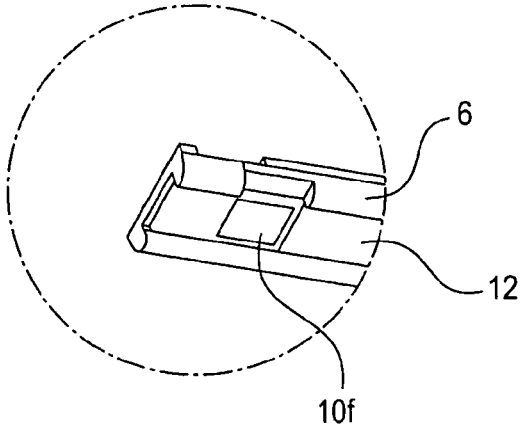
Figure 3C:
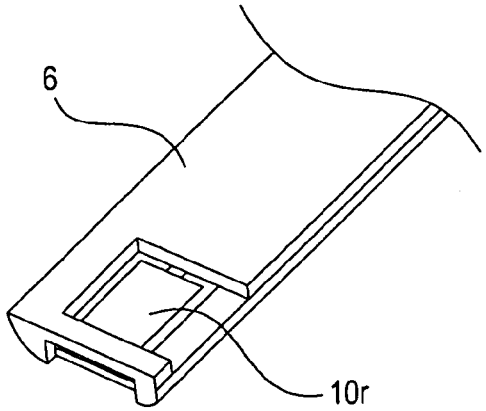
Figure 4:
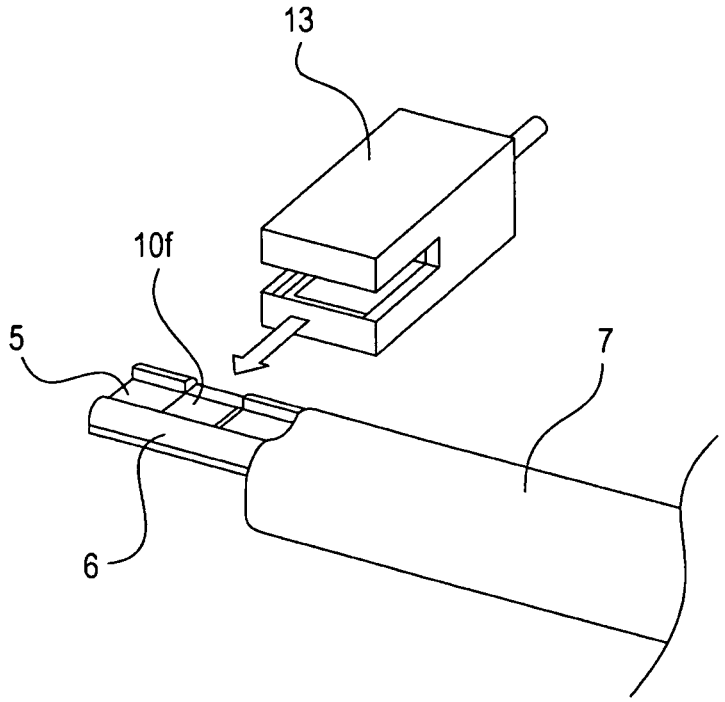
FIG. 4 is a drawing for showing how the power supply connector attaches itself to the electrode portion of the heater, in the first embodiment.

Next, referring to FIGS. 3 and 4, how the connector 13 is attached to the heating unit 2 is described.

FIG. 3 shows how the heater 5 is supported by the heater supporting member 6. FIG. 3(*a*) shows the entirety of the combination of the heater 5 and heater supporting member 6. FIG. 3(*b*) shows the side of the heater 5, which contacts the film 7. FIG. 3(*c*) shows the end portion of the heater supporting member 6, which faces the heater 5 and has a cutaway. The heater supporting member 6 supports the heater 5, by holding the heater 5 in its groove which extends in its lengthwise direction of the heater (heater supporting member 6). It controls the film 7 in terms of the lateral movement of the film 7 as the film 7 is circularly moved. The cutaway portion of the heater supporting member 6 is positioned so that the electrode 10*f*, for example, is exposed through the cutaway. The electrodes 10*f* and 10*r* are connected to the connector 13 which has a pair of spring contacts. However, the two electrodes 10, which are on the other lengthwise ends of the heater supporting member 6 from the electrodes 10*f* and 10*r* are connected to two connectors 13, which are independent from each other. That is, in terms of the electrical circuit, the heating unit 2 in this embodiment is structured to use three connectors to enable the two heat generating members 8 to be independently controlled from each other.

In a case where the electrode 10*r* is on the heater supporting side of the heater supporting member 6, the cutaway portion of the heater supporting member 6 is positioned so that the side of the electrode 10*f*, which is exposed through the cutaway, is on the heater supporting surface side of the heater supporting member 6.

FIG. 4 is a drawing which shows how the connector 13 mates with the heater 5. The connector 13 is moved toward the lengthwise end portion of the heater supporting member 6 in the direction indicated by an arrow mark so that it attaches itself to the portion of the heater supporting member 6, which is on the outward side of the track of the film 7. That is, the connector 13 is connected to the lengthwise end portion of the heater 5.

(Structure of Connector)

Figure 5:
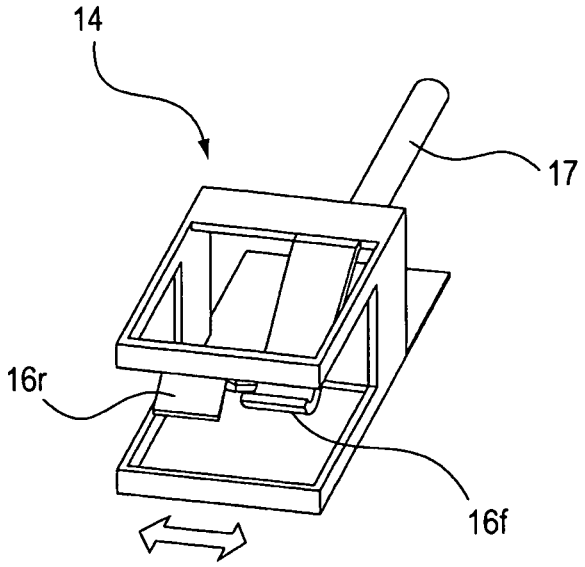
FIG. 5 is a perspective view of the contact terminals of the power supply connector in the first embodiment, and illustrates the shape of the contact terminals.
Figure 6:
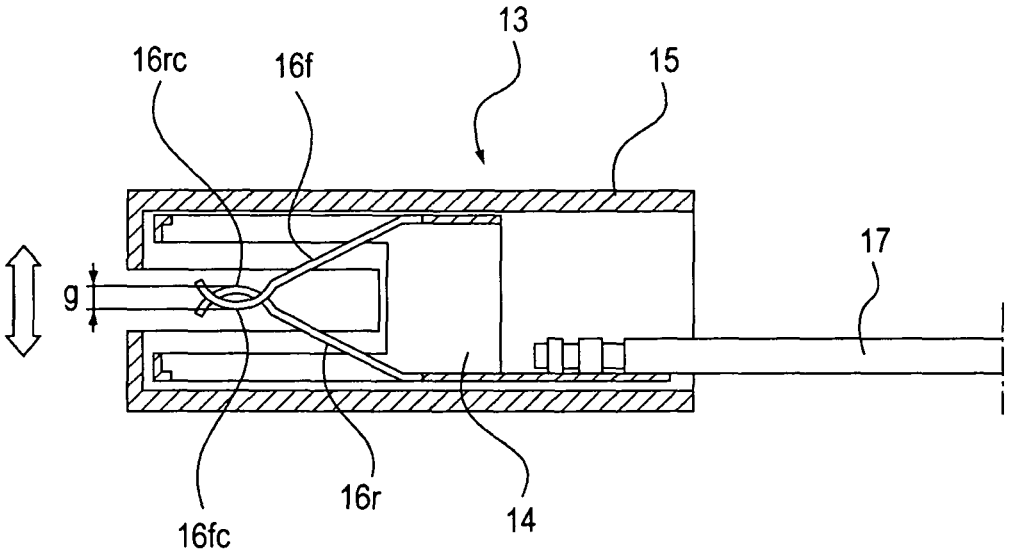
FIG. 6 is a sectional view of the power supply connector in the first embodiment.

Next, referring to FIGS. 5 and 6, the structure of the connector 13 is described.

FIG. 5 is a drawing which shows the shape of the terminal 14 of the connector 13. The connector terminal 14 is shaped so that its cross section appears roughly U-shaped. It is made of stainless steel, titanium alloy, or the like material, and is plated. It is provided with a pair of spring contacts, more specifically, spring contacts 16*f* and 16*r* (first and second spring contacts, respectively), which extend into the space of the connector 13, which corresponds in position to the void of the U-shaped portion. As the connector 13 is made to attach itself to the abovementioned lengthwise end of the heater 5, the spring contacts 16*f* and 16*r* (first and second spring contacts) come into contact with the electrodes 10*f* and 10*r* of the heater 5. The first spring contact 16*f* is provided with the first point 16*fc* of contact, which contacts the first electrode 10*f* on the substrate 9, and the second spring contact 16*r* is provided with the second point 16*c* of contact, which contacts the second electrode 10*r* on the substrate 9. These spring contacts 16*f* and 16*r* are resiliently bendable in the direction intersectional to the heater supporting surface of the dielectric substrate 9. Thus, as the connector 13 is engaged with the heater 9 and the heater supporting member 9, the points 16*fc* and 16*rc* of contact of the spring contacts 16*f* and 16*r* come into contact with the electrodes 10*f* and 10*r*, respectively, while the spring contacts 16*r* and 16*r* are made to resiliently bend in the abovementioned direction.

The connector terminal 14 is in connection to a lead 17 which is made up of a bundle of fine wires and is crimped to one end of the terminal 14. It is in connection to the control chip (unshown) through the lead 17.

FIG. 6 is a sectional view of the connector 13. The connector 13 has a dielectric housing 15, and a terminal 14 held in the housing 15. The housing 15 of the connector 13 is roughly U-shaped in cross section, like the terminal 14. The connector terminal 14 is held in the housing by being forcefully inserted into the housing 15 from the opposite side of the housing 15 from the opening of the housing 15, which corresponds in position to the open end of a letter U. The points 16*fc* and 16*rc* of contact (first and second points of contact) are offset from each other in the direction perpendicular to the direction (indicated by arrow mark in FIG. 5) in which the connector 13 is to be attached to the heater 5 and heater supporting member 6. That is, the first and second points 6*fc* and 16*rc* of contact are positioned so that when they are displaced by the bending of the spring contacts 16*f* and 16*r*, they do not interfere with each other. Thus, the spring contacts 16*f* and 16*r* are allowed to be bent in the direction (indicated by arrow mark in FIG. 6) perpendicular to the electrodes 10*f* and 10*r* without interfering with each other. That is, the two spring contacts 16*f* and 16*r* are different in position in terms of the direction parallel to the heat generating member supporting surface of the substrate 9.

When the connector 13 is in engagement with the heating unit 2, the spring contacts 16*f* and 16*r* remain overlapped with each other by a distance g in terms of the direction (in which spring contacts are bent) in which the points 16*fc* and 16*rc* of contact are displaced (distance g can be changed within range in which points of contact do not come into contact with housing 15 or the like).

Figure 7A:
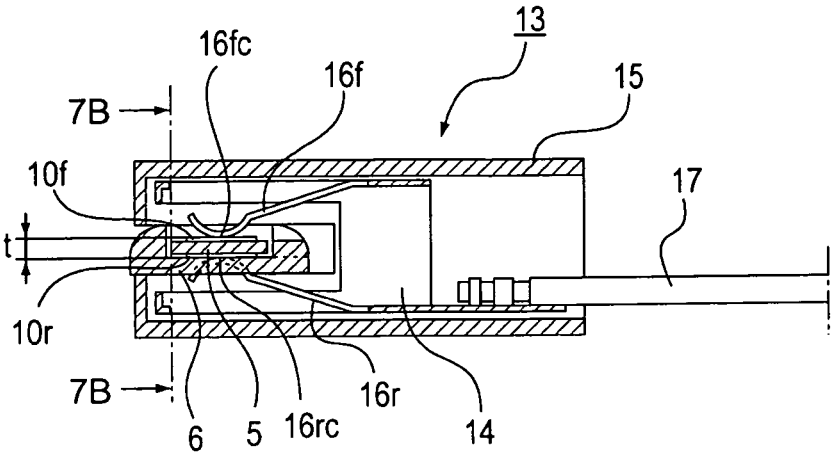
FIGS. 7A and 7B are sectional views of the power supply connector in the first embodiment after the mating of the power supply connector with the heater supporting member, at planes parallel and perpendicular, respectively, to the direction in which the connector is engaged.
Figure 7B:
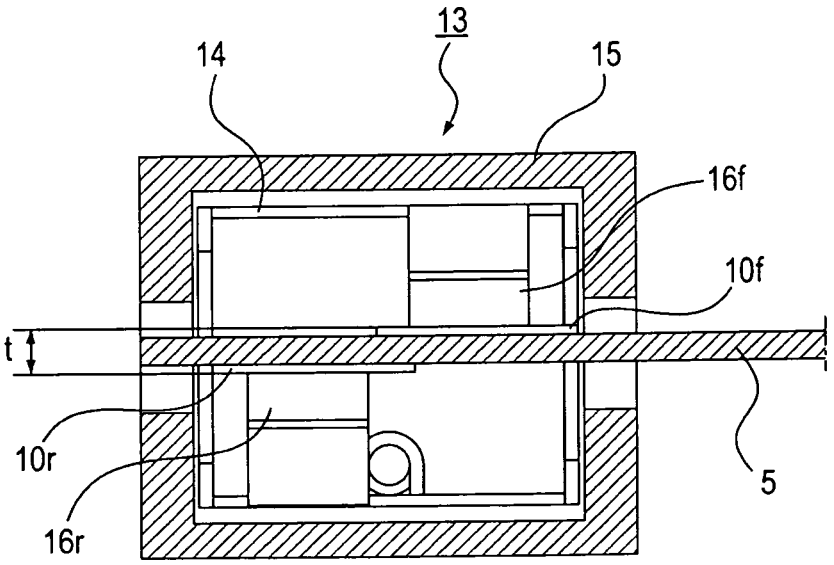

FIG. 7 is a sectional view of the combination of the connector 13 and the lengthwise end portion of the heater 5, after the connector 13 has been mated with the heater supporting member 6 on which the heater 5 is present. FIG. 7(*a*) is a sectional view of the combination at a plane parallel to the direction in which the connector 13 was made to attach itself to the heater 5 and heater supporting member 6, and FIG. 7(*b*) is sectional view of the combination at a plane parallel (as shown in FIG. 7(*a*)) to the lengthwise direction the heater 5. The heater supporting member 6 is not shown, for the simplification of the description of the connector 13. Referring to these drawings, as the connector 13 is made to attach itself to the heater 5 and heater supporting member 6, the spring contacts 16*f* and 16*r* are resiliently bent. Thus, a preset amount of contact pressure is generated between the points 16*fc* and 16*rc* and the electrodes 10*f* and 10*r*, respectively.

That is, the spring contacts 16*f* and 16*r* are resiliently bendable in the direction perpendicular to the surface of the heater 5. Thus, as the connector 13 is made to engage with the heater 5, the points 16*fc* and 16*rc* are made to press on the electrodes 10*f* and 10*r*, by the resiliency of the spring contacts 16*f* and 16*r*, respectively.

The connector 13 is structured so that the vertical projections of the points 16*fc* and 16*rc* of contact upon the surface of the heater 5 are different in position. Further, the connector 13 is structured so that when the connector 13 is not in engagement with the heater 5, the spring contacts 16*f* and 16*r* overlap with each other as seen from the direction perpendicular to the direction in which the connector 13 is engaged with the heater 5. Further, the heater 5 is in the form of a long and narrow rectangle, and the vertical projections of the points 16*fc* and 16*rc* of contact upon the surface of the heater 5 are offset from each other in the lengthwise direction of the heater 5.

The heater 5 is in the form of a long and narrow rectangle as described above. Therefore, structuring the connector 13 so that the points 16*fc* and 16*rc* of contact are offset in position from each other in terms of the lengthwise direction of the heater 5 makes it possible to provide the connector 13 with spring contacts which are greater in size than a spring contact with which the connector 13 can be provided in a case where the connector 13 is structured so that the points 16*fc* and 16*rc* of contact are offset from each other in the widthwise direction of the heater 5. Further, It can reduce the connector 13 in the amount of the friction which occurs between the points 16*fc* and 16*rc* of contact and the electrodes of heater 5 when the connector 13 is engaged with the heater 5, and also, makes it possible for the heater 5 to remain reliably in contact with the points 16*fc* and 16*rc* of contact. In other words, it makes it possible to narrow the heater 5 to reduce the heating unit 2 in size, without reducing the electrodes in size.

That is, in the case of the connector 13 in this embodiment, there is nothing to interfere with the resilient bending of the spring contacts 16*f* and 16*r*. Thus, the distance by which the points 16*fc* and 16*rc* of contact of the spring contacts 16*f* and 16*r*, respectively, are displaced in the direction intersectional to the surface of the heater 5 is hardly affected by the thickness t of the heater 5. Therefore, it is ensured that as the connector 13 is engaged with the heater 5 and heater supporting member 6, the preset amount of contact pressure is generated and maintained between the points 16*fc* and 16*rc* of contact and the electrodes 16*f* and 16*r*, respectively. Further, it does not occur that the points 16*fc* and 16*rc* of contact of the connector terminal 14 rub against each other when the connector 13 is moved around and/or the printer 100 (image forming apparatus) is moved around. Therefore, the contact failure attributable to the rubbing of the points 16*fc* and 16*rc* of contact against each other is unlikely to occur.

<Embodiment 2>

Next, referring to FIGS. 8-12, the second embodiment of the present invention is described.

Here, the portions of the connector 13 and heating unit 2 in this embodiment, which are the same as the counterparts in the first embodiment are not going to be described. This embodiment is different from the first embodiment in the direction in which the connector 13 is moved to be made to attach itself to the heater 5 and heater supporting member 6, and also, the shape of the connector terminal 14.

Figure 8A:
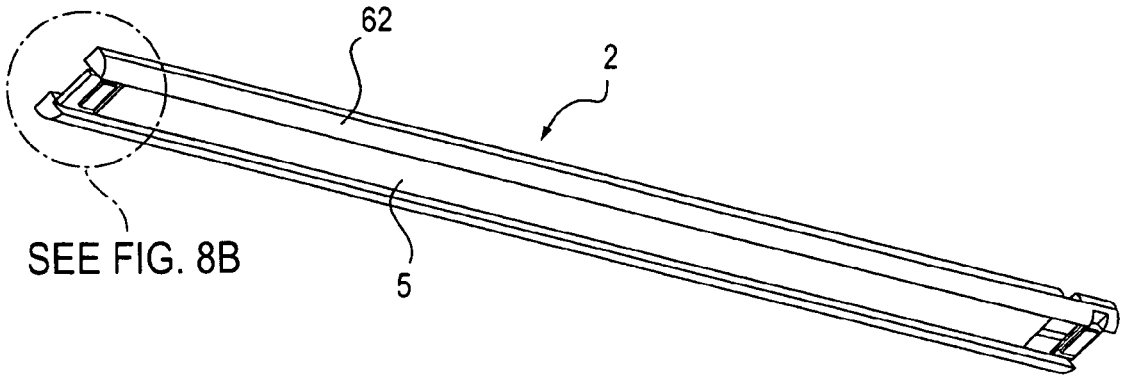
FIGS. 8A, 8B, and 8C are drawings for showing how the heater is supported by the heater supporting member, in the second embodiment of the present invention.
Figure 8B:
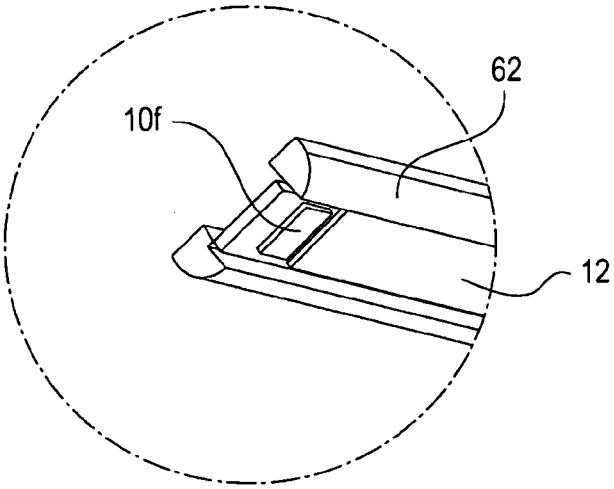
Figure 8C:
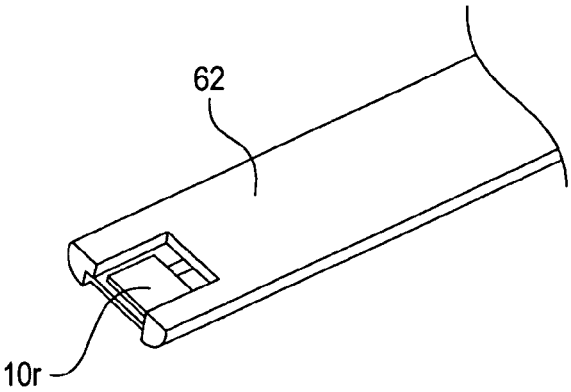
Figure 9:
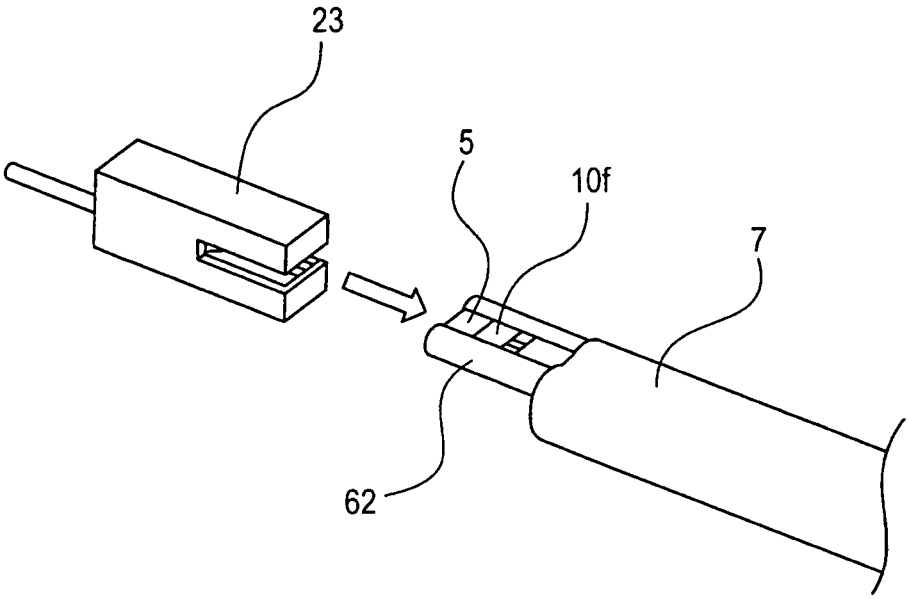
FIG. 9 is a drawing for showing how the power supply connector attaches itself to the electrode portion of the heater, in the second embodiment.

First, referring to FIGS. 8 and 9, how the connector 13 is attached to the heater 5 and heater supporting member 6 is described.

FIG. 8 illustrates how the heater 5 is supported by the heater supporting member 6. FIG. 8(*a*) shows the entirety of the combination of the heater 5 and heater supporting member 62 (substrate holder). FIG. 8(*b*) shows the film contacting side of the heater 5. FIG. 8(*c*) shows the end portion of the heater supporting member 62, which faces the heater 5 and has a cutaway. The heater supporting member 62 supports the heater 5, by holding the heater 5 in its groove which extends in its lengthwise direction. It controls the film 7 in terms of the lateral movement of the film 7 as the film 7 is circularly moved. The cutaway portion of the heater supporting member 62 is positioned so that the electrode 10*f*, for example, is exposed through the cutaway.

In a case where the electrode 10*r* is on the heater supporting side of the heater supporting member 62, the cutaway portion of the heater supporting member 62 is positioned so that the side of the electrode 10*f*, which is exposed through the cutaway, is on the heater supporting surface side of the heater supporting member 62.

FIG. 9 is a drawing which shows how the connector 23 attaches itself to the heater 5. The connector 23 is moved toward the lengthwise end portion of the heater supporting member 62 in the direction indicated by an arrow mark so that it engages with the lengthwise end of the heater 5 and heater supporting member 62.

Figure 10:
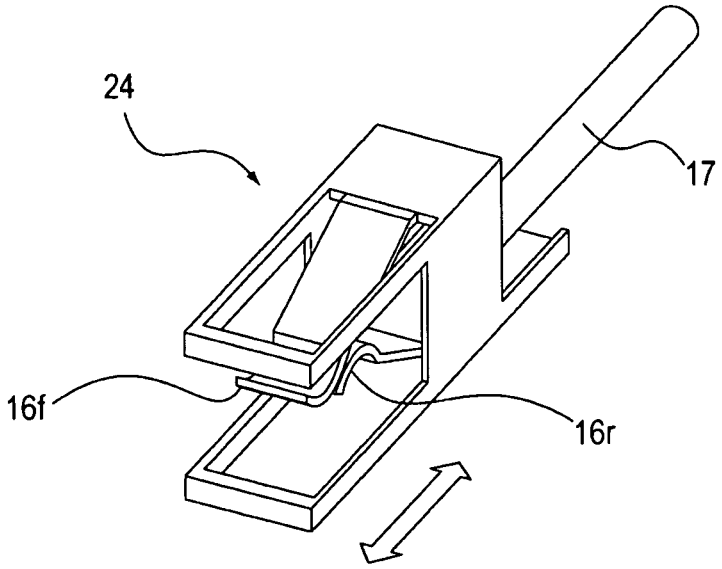
FIG. 10 is a perspective view of the contact terminals of the power supply connector in the second embodiment, and illustrates the shape of the contact terminals.
Figure 11:
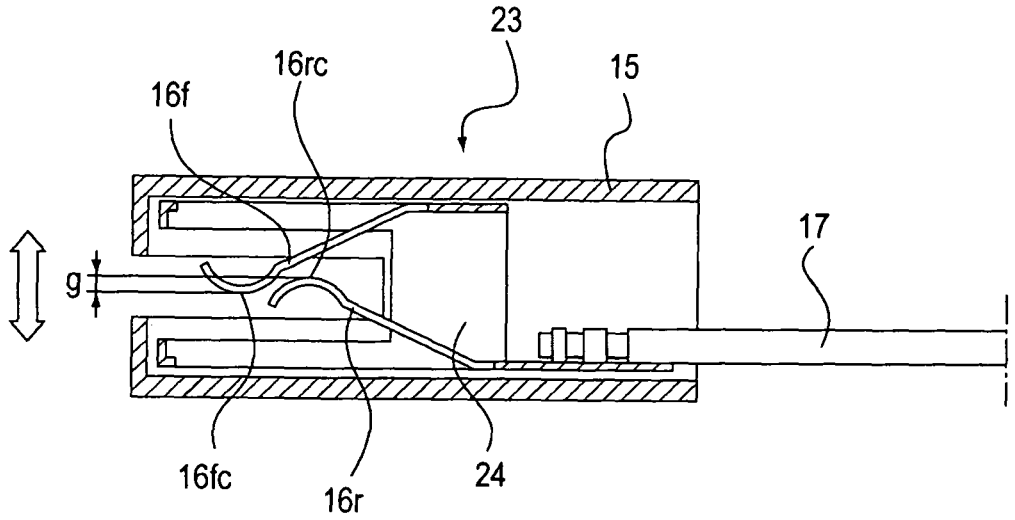
FIG. 11 is a sectional view of the power supply connector in the second embodiment.

Next, referring to FIGS. 10 and 11, the structure of the connector 23 is described. FIG. 10 shows the shape of the terminal 24 of the connector 23. The terminal 24 is shaped so that its cross section appears roughly U-shaped. It is made of stainless steel, titanium alloy, or the like material, and is plated. It is provided with a pair of spring contacts, more specifically, spring contacts 16*f* and 16*r*, which extend into the internal space of the connector 23, which corresponds in position to the void of the U-shaped portion of the connector 23. As the connector 23 engages with the abovementioned lengthwise end of the heater 5, the spring contacts 16*f* and 16*r* come into contact with the electrodes 10*f* and 10*r* of the heater 5, and are made to resiliently bend in the abovementioned direction. The terminal 14 is in connection to a lead 17 which is made up of a bundle of wires and is crimped to one end of the terminal 14. It is in connection to the control chip (unshown) through the lead 17. In this embodiment, the electrodes 10*f* and 10*r* are in connection to each other through a common lead.

Figure 16A:
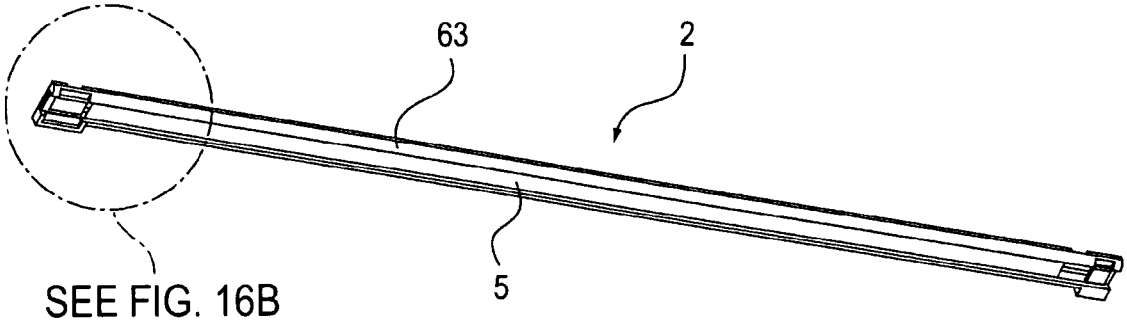
FIGS. 16A, 16B, and 16C are drawings for showing how the heater is supported by the heater supporting member, in the fourth embodiment of the present invention.
Figure 16B:
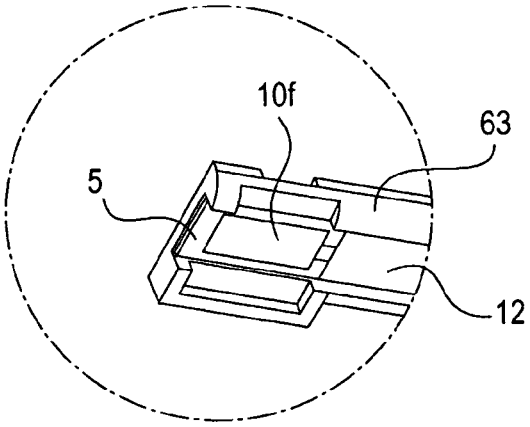
Figure 16C:
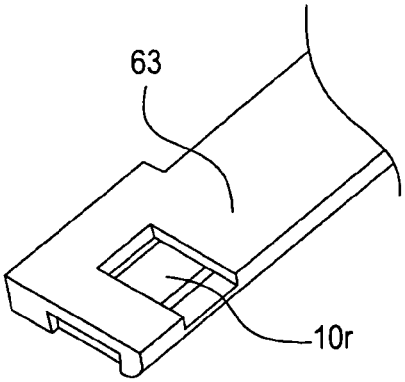

FIG. 16 is a sectional view of the connector 23. The connector 23 has a housing 15, and a terminal 14 held in the housing 15. The housing 15 of the connector 23 is roughly U-shaped in cross section, like the terminal 14. The connector terminal 14 is held in the housing 15 by being forcefully inserted into the housing 15 from the opposite side of the housing 15 from the opening of the housing, which corresponds in position to the open end of the U-shaped portion of the housing 15. The spring contacts 16*f* and 16*r* are offset from each other in the direction parallel to the direction (indicated by arrow mark in FIG. 10) in which the connector 23 is to be engaged with the heater 5 and heater supporting member 62. That is, the spring contacts 16*f* and 16*r* are positioned so that when they are resiliently bent in the direction perpendicular to the electrodes 10*f* and 10*r*, they do not interfere with each other. The connector 23 is structured so that the vertical projections of the points 16*fc* and 16*rc* of contact upon the surface of the long and narrow rectangular heater 5 are different in position. That is, the connector 23 is structured so that when the connector 23 is engaged with the heater 5 and heater supporting member 62, the first and second points 16*fc* and 16*rc* of the spring contacts 16*f* and 16*r*, respectively, are not made to come into contact with each other, by the bending of the spring contacts 16*f* and 16*r*.

Further, the connector 23 is structured so that the spring contacts 16*f* and 16*r* overlap with each other by a distance g as seen from the direction parallel to the direction in which the connector 23 is engaged with the heater 5. The distance g may be changed, provided that the change does not cause the points 16*fc* and/or 16*rc* of contact to come into contact with the housing 15 or the like.

Figure 12:
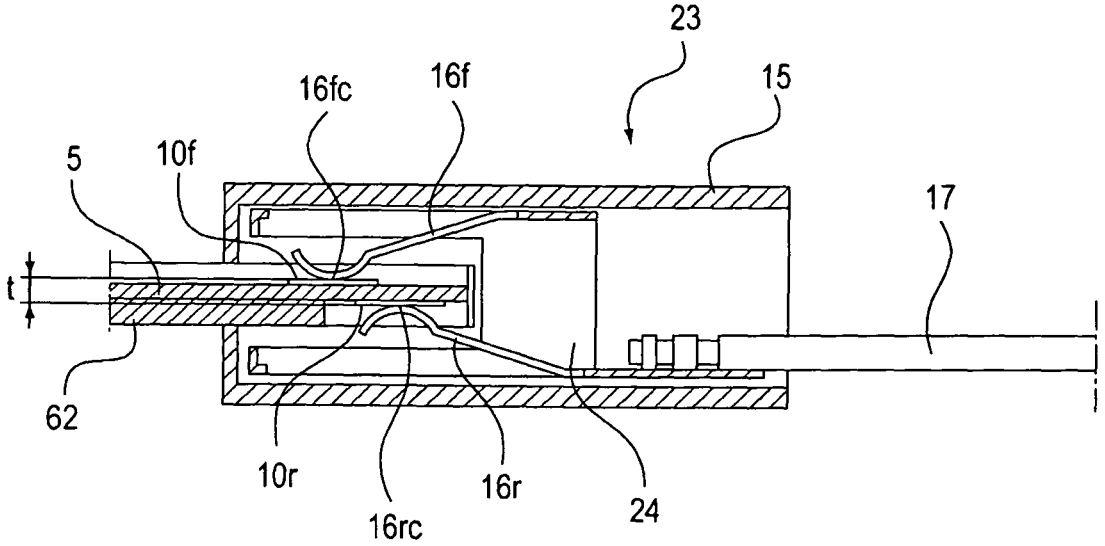
FIG. 12 is a sectional view of the combination of the heater electrode and the power supply connector, in the second embodiment, after the mating of the connector with the heater supporting member.

FIG. 12 is a sectional view of the combination of the connector 23 and the lengthwise end portion of the heater 5, after the connector 23 attached itself to the heater supporting member 62 on which the heater 5 is present. As is evident from FIG. 12, as the connector 23 attaches itself to the heater supporting member 62, the spring contacts 16*f* and 16*r* come into contact with the electrodes 10*f* and 10*r*, respectively, and are made to resiliently bend by the electrodes 10*f* and 10*r*, providing thereby a preset amount of contact pressure between themselves and the electrodes 10*f* and 10*r*, respectively.

That is, in the case of the connector 23 in this embodiment, there is nothing to interfere with the resilient bending of its spring contacts 16*f* and 16*r*. Thus, the distance by which the points 16*fc* and 16*rc* of contact of the spring contacts 16*f* and 16*r*, respectively, are displaced is hardly affected by the thickness t of the heater 5. Therefore, it is ensured that as the connector 23 is engaged with the heater 5 and heater supporting member 62, the preset amount of contact pressure is generated and maintained between the points 16*fc* and 16*rc* of contact and the electrodes 10*f* and 10*r*, respectively. Further, it does not occur that the points 16*fc* and 16*rc* of contact of the connector terminal 14 rub against each other when the connector 23 is moved around and/or the printer 100 (image forming apparatus) is moved around. Therefore, the contact failure attributable to the rubbing of the points 16*fc* and 16*rc* of contact against each other is unlikely to occur.

As will be evident from the description of the second embodiment of the present invention given above, even in a case where the present invention is applied to the fixing device structured so that the connector 23 is to be made to attach itself to the heater 5 and heater supporting member 62 in the direction parallel to the lengthwise direction of the heater 5, the effect of the present invention are the same as those obtained by the second embodiment. Further, in this embodiment, the points of contact of the connector 23, which contact the front and rear sides of the heater substrate, are offset from each other in the direction parallel to the lengthwise direction of the substrate. Therefore, it is unnecessary to increase the heater in width, making it unnecessary to increase the heating unit in size.

<Embodiment 3>

Figure 13:
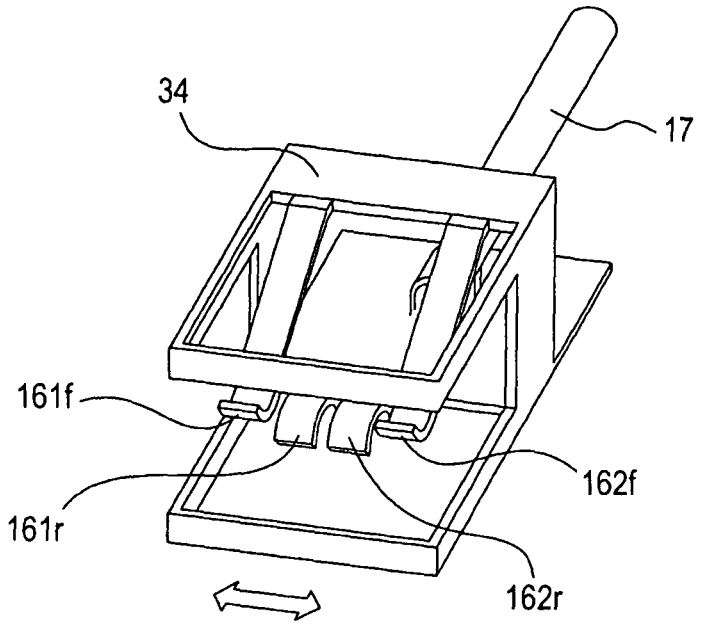
FIG. 13 is a perspective view of the contact terminals of the power supply connector in the third embodiment, and illustrates the shape of the contact terminals.
Figure 14:
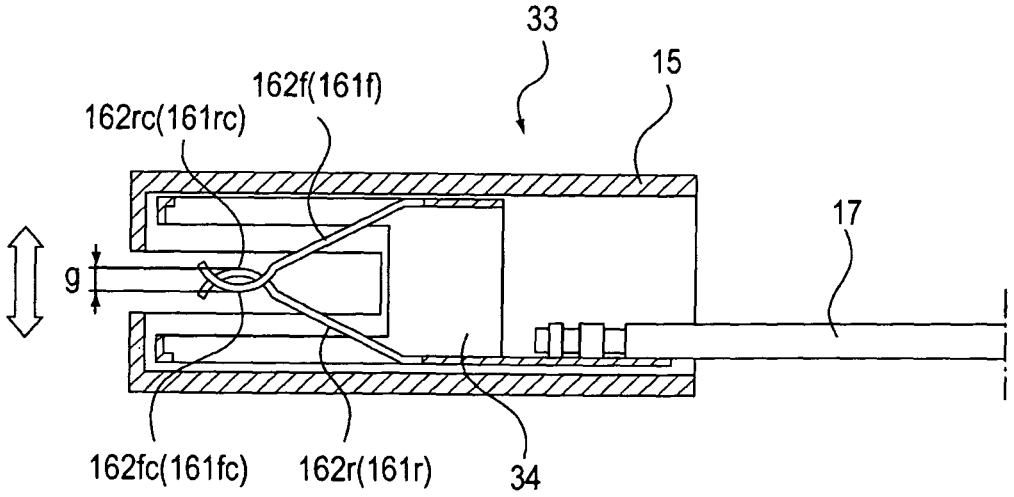
FIG. 14 is a sectional view of the power supply connector, in the third embodiment.
Figure 15A:
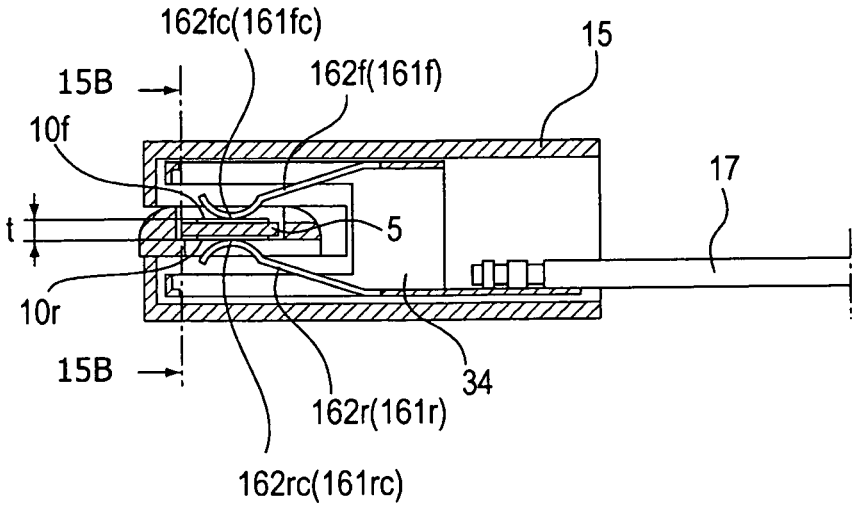
FIGS. 15A and 15B are sectional views of the power supply connector in the third embodiment after the mating of the power supply connector with the heater supporting member, at planes parallel and perpendicular, respectively, to the direction in which the connector is engaged.
Figure 15B:
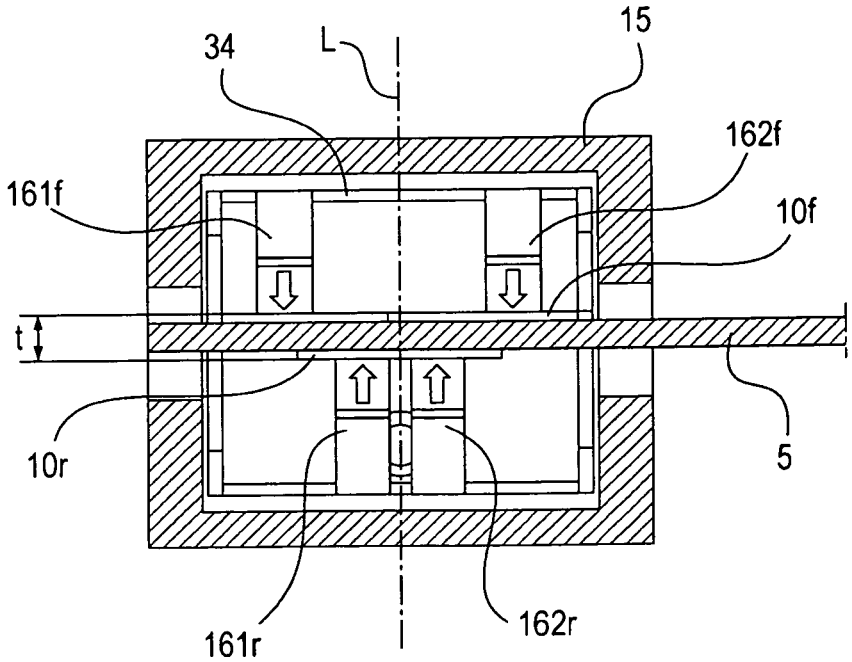

Next, referring to FIGS. 13-15, the third embodiment of the present invention is described.

Here, the portions of the fixing device 1 in this embodiment, which are the same as the counterparts in the first embodiment are not going to be described. This embodiment is different from the first one in the shape of the spring contacts.

First, referring to FIGS. 13 and 14, the structure of the connector 33 is described.

FIG. 13 shows the shape of the terminal 34 of the connector 33. The terminal 34 is shaped so that its cross section appears roughly U-shaped. It is made of stainless steel, titanium alloy, or the like material, and is plated. It is provided with a pair of spring contacts 161*f* and 162*f*, which contact the electrode 10*f*, and a pair of spring contacts 161*r* and 162*r*, which contact the electrode 16*r*. These spring contacts extend into the internal space of the connector 33, which corresponds in position to the void of the U-shaped portion of the connector 33. The pair of spring contacts 161*r* and 162*r* are between the spring contact 161*f* and 161*r* in terms of the direction indicated by an arrow mark. The connector terminal 34 is in connection to a lead 17 which is made up of a bundle of fine wires and is crimped to one end of the terminal 34. It is in connection to the control chip (unshown) through the lead 17.

FIG. 14 is a sectional view of the connector 33. The connector 33 has a housing 15, and a terminal 34 held in the housing 15. The housing 15 of the connector 33 is roughly U-shaped in cross section, like the terminal 34. The connector terminal 34 is held in the housing 15 by being forcefully inserted into the housing 15 from the opposite side of the housing 15 from the opening of the housing, which corresponds in position to the open end of the U-shaped portion of the connector 33. The spring contacts 161*f*, 162*f*, 161*r* and 162*r* are offset from each other in the direction perpendicular to the direction (indicated by arrow mark in FIG. 13) in which the connector 33 is attached to the heater 5 and heater supporting member 62. That is, the spring contacts 161*f*, 162*f*, 161*r* and 162*r* are positioned so that when they are made to resiliently bend in the direction (indicated by arrow mark in FIG. 13) perpendicular to the electrodes 10*f* and 10*r*, they do not interfere with each other.

Further, the connector 33 is structured so that the points 161*fc*, 162*fc*, 161*rc* and 162*rc* of contact of the spring contacts 161*f*, 162*f*, 161*r* and 162*r*, respectively, overlap with each other by a distance g as seen from the direction parallel to the direction in which the connector 33 is engaged with the heater 5. The value of the distance g is optional, provided that the change in the value does not cause the points of contact to come into contact with the housing 15 or the like.

FIG. 15 is a sectional view of the combination of the connector 33 and the lengthwise end portion of the heater 5, after the connector 33 attached itself to the heater supporting member 62 on which the heater 5 is present. FIG. 15(*a*) is a sectional views of the combination of the connector 34 and the lengthwise end portion of the heater 5, at a plane parallel to the direction in which the connector 34 is made to attach itself to the heater 5 and heater supporting member 62, and FIG. 15(*b*) is a sectional view of the combination at a plane parallel (as shown in FIG. 15(*a*)) to the lengthwise direction of the heater 5. For the simplification of the description of the combination, the heater supporting member 62 is not shown in the drawings. As will be evident from the drawing, as the connector 33 is made to attach itself to the heater 5 and heater supporting member 62, the spring contacts 161*f* and 162*f* contact the electrode 10*f*, and the spring contact 161*r* and 162*r* contact the electrode 10*r*. That is, each electrode is contacted by two spring contacts. Further, the spring contacts 161*f* and 162*f* are symmetrically positioned with reference to the centerline L of the connector terminal 34, and the spring contacts 161*r* and 162*r* also are symmetrically positioned with reference to the centerline L of the connector terminal 34 (FIG. 15(*b*)).

Incidentally, the spring contacts 161*f* and 162*f* make up the first electrode portion of the connector 33, and the spring contacts 161*r* and 162*r* make up the second electrode portion of the connector 33.

As the connector 33 is connected to the heater 5, the spring contacts 161*f* and 162*f* come into contact with the electrode 10*f* by their points 161*fc* and 162*fc* of contact (two points of contact), and the spring contacts 161*r* and 162*r* come into contact with the electrode 10*r* by their points 161*rc* and 162*rc* of contact (two points of contact). The connector 33 is structured so that the points 161*fc*, 162*fc*, 161*rc* and 162*rc* are different in the position of their vertical projection upon the surface of the heater 5.

Therefore, there is nothing to interfere with the resilient bending of its spring contacts 161*f*, 162*f*, 161*r* and 162*r*. Thus, the distance by which the points 161*fc*, 162*fc*, 161*rc* and 162*rc* of contact are displaced by the bending of the spring contacts is hardly affected by the thickness t of the heater 5. Therefore, it is ensured that as the connector 33 is engaged with the heater 5, the preset amount of contact pressure is generated and maintained between the points of contact and the corresponding electrode.

Further, it does not occur that the points 161*fc*, 162*fc*, 161*rc* and 162*rc* of contact of the connector terminal 34 rub against each other when the connector 33 is moved around and/or the printer 100 (image forming apparatus) is moved around. Therefore, the contact failure attributable to the rubbing of the points of contact against each other is unlikely to occur.

In addition, in the case of this embodiment, a single electrode is contacted by the pair of symmetrically positioned spring contacts in such a manner that one of the symmetrically positioned spring contact contacts the front side of the electrode, whereas the other contacts the rear side of the electrode. Therefore, the connector terminal 34 is kept stable in attitude. Therefore, it is unlikely to occur that the contact pressure between the point of contact of a springy electrode and the corresponding electrode of the heater is reduced by the change in the attitude of the connector 33.

Further, the spring contact 161*f* is positioned closest to the lengthwise end of the heater 5 among the four spring contacts. Therefore, the reactive force from the spring contact 161*f* is caught by the heater supporting member, whereby the shearing stress to which the lengthwise end portion of the heater 5 is subject is reduced. Further, the lengthwise end portion of the heater 5 is sandwiched by the heater supporting member and the spring contact 161*f*. That is, the heater 5 remains securely supported.

<Embodiment 4>

Next, referring to FIGS. 16-20, the fourth embodiment of the present invention is described.

Here, the portions of the fixing device in this embodiment, which are the same as the counterparts in the first and third embodiments are not described. It is in the shape of the heater supporting member that this embodiment is different from the first and third embodiments.

Figure 17:
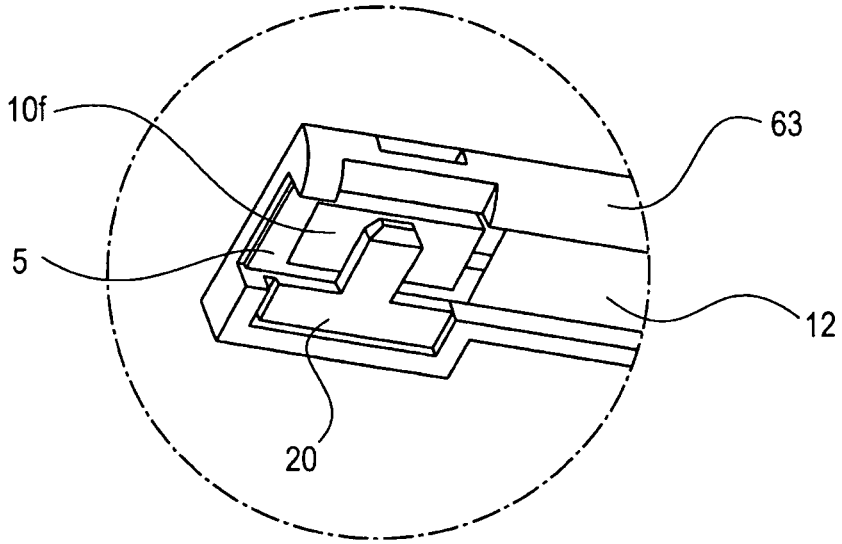
FIG. 17 is a drawing for showing the lengthwise end portion of the heating unit after the attachment of the supporting member which backs up the heater shown in FIG. 16(*a*).

First, referring to FIGS. 16 and 17, how the connector 13 is engaged with the heating unit 2 is described.

FIG. 16 shows how the heater 5 is supported by the heater supporting member 63 (substrate holder). FIG. 6(*a*) shows the entirety of the combination of the heater 5 and heater supporting member 63. FIG. 16(*b*) shows the side of the heater 5, which contacts the film 7. FIG. 16(*c*) shows the end portion of the heater supporting member 63, which faces the heater 5 and has a cutaway. The heater supporting member 63 supports the heater 5, by holding the heater 5 in its groove which extends in its lengthwise direction. It controls the film 7 in terms of the lateral movement of the film 7 as the film 7 is circularly moved. The cutaway portion of the heater supporting member 63 is positioned so that the electrode 10*f*, for example, is exposed through the cutaway.

In a case where the electrode 10*r* is on the heater supporting side of the heater supporting member 63, the cutaway portion of the heater supporting member 6 is positioned so that the side of the electrode 10*f*, which is exposed through the cutaway, is on the heater supporting surface side of the heater supporting member 63.

FIG. 17 shows the lengthwise end of the heating unit 2 after the attachment of a supporting member 20 (shown in FIG. 16(*a*)) which supports the heater 5, to the heating unit 2. The connector 33 in the third embodiment attaches itself to the lengthwise end portion of the heating unit 2 which is in the state in which the heater 5 is remaining sandwiched by the heater supporting member 63 and a supporting member 20.

Figure 18:
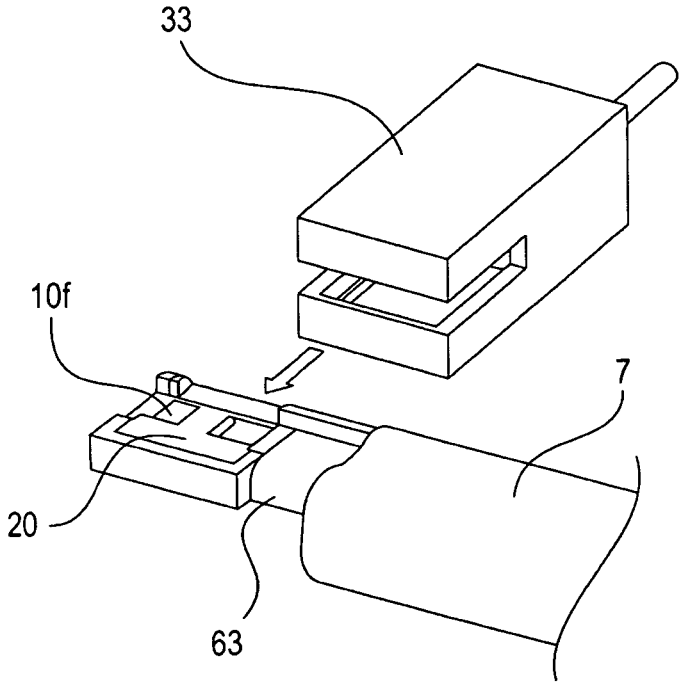
FIG. 18 is a drawing for showing how the power supply connector attaches itself to the electrode portion of the heater, in the fourth embodiment.

FIG. 18 is a drawing which shows how the connector 33 attaches itself to the heater 5. The connector 33 attaches itself to the heater supporting member 63 by being moved in the direction indicated by an arrow mark, on the outward side of the lateral edge of the film 7.

Figure 19A:
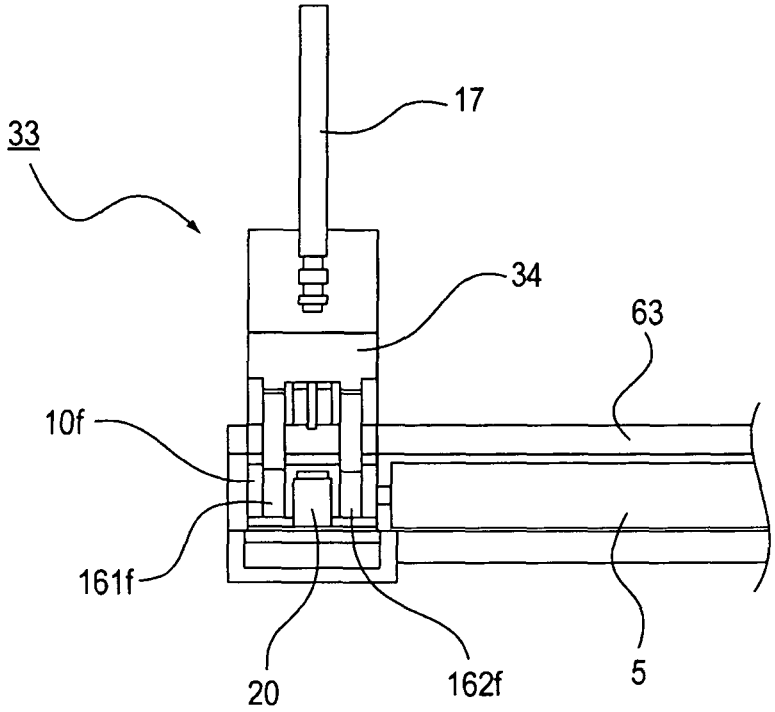
FIGS. 19A and 19B are top and bottom, respectively, plan views of the combination of the electrode portion of the ceramic heater and the power supply connector, in the fourth embodiment, after the attachment of the connector to the electrode portion.
Figure 19B:
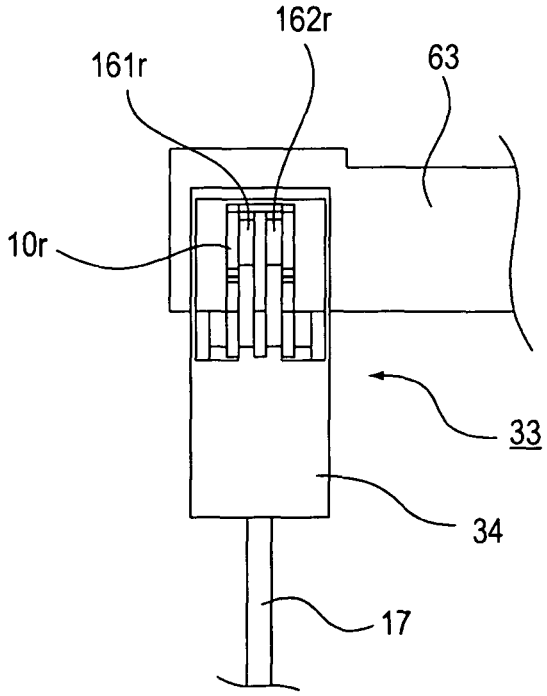

Next, FIG. 19 shows the state of the combination of the connector 33 and the lengthwise end portion of the heating unit 2 after the connector 33 attached itself to the heater 5. Here, the housing 15 is not illustrated for the simplification of the description. FIG. 19(*a*) is a plan view of the abovementioned combination as seen from the side on which the heater 5 contacts the film 7. The supporting member 20 is positioned between the spring contact 161*f* and 162*f*. FIG. 19(*a*) is a plan view of the combination as seen from the rear side of FIG. 19(*a*).

Figure 20A:
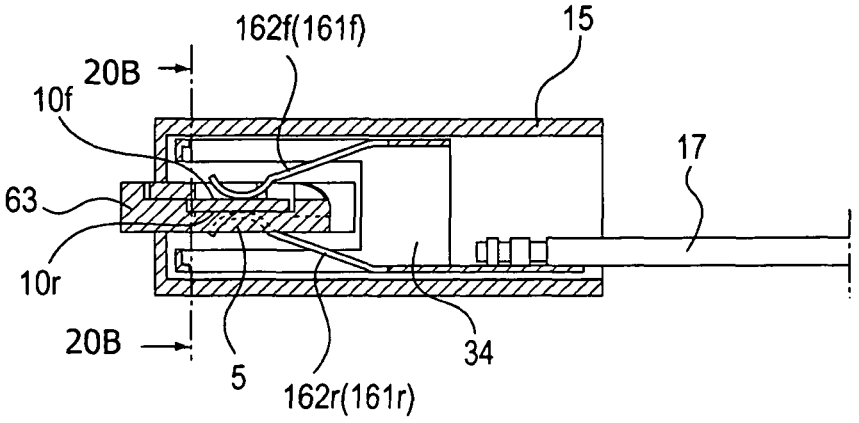
FIGS. 20A and 20B are sectional views of the combination of the power supply connector and the electrode portion of the ceramic heater, in the fourth embodiment, after the attachment of the power supply connector to the electrode portion, at planes parallel and perpendicular, respectively, to the direction in which the connector is engaged, after the attachment of the connector to the heater supporting member.
Figure 20B:
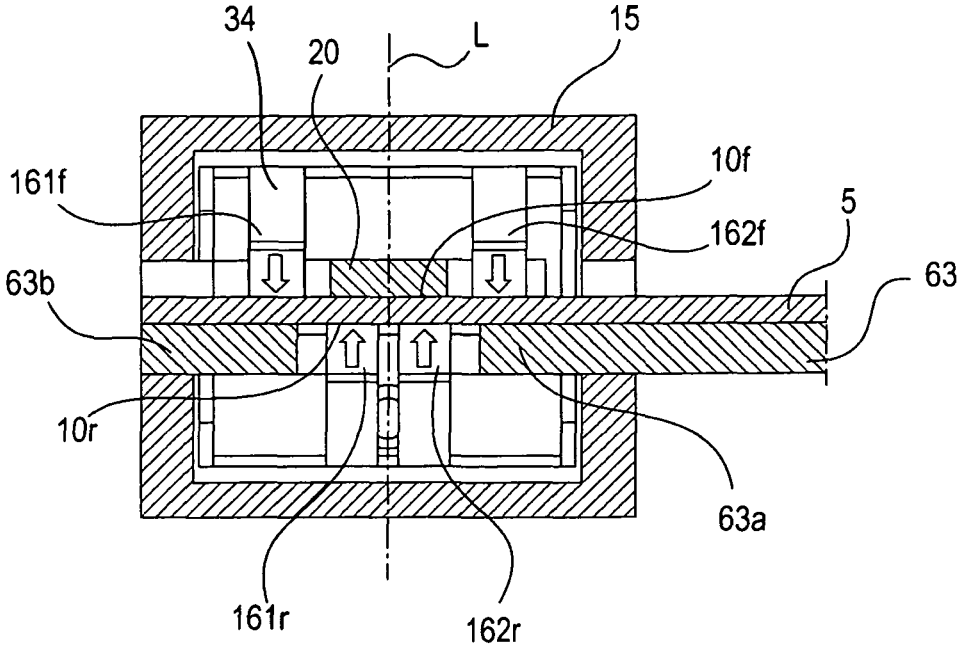

FIG. 20 is a sectional view of the combination of the connector 33 and the lengthwise end portion of the heating unit 2 after the connector 33 attached itself to the heater supporting member 63 on which the heater 5 is present. FIG. 20(*a*) is a sectional view of the combination at a plane parallel to the direction in which the connector 33 is made to attach itself to the heater 5, and FIG. 20(*b*) is a sectional views of the combination at plane parallel (shown in FIG. 20(*a*)) to the lengthwise direction of the heater 5.

As will be evident from these drawings, the heating unit 2 is structured so that the actual supporting portions 63*a* and 63*b* of the heater supporting member 63 are positioned on the opposite side of the heater 5 from the spring contacts 161*f* and 162*f*, respectively, and back up the heater 5 against the contact pressure generated by the spring contacts 161*f* and 162*f*. Further, the spring contact 161*f* is positioned closest to the lengthwise end of the heater 5 among the four spring contacts 161*f*, 162*f*, 161*r* and 162*r*, and the reactive force generated by the spring contact 161*f* is caught by the actual supporting portion 63*b* of the supporting member 63. Therefore, the heating unit 2 in this embodiment is smaller in the amount of the shearing stress to which the lengthwise end portion of the heater 5 is subjected, than any heating unit in accordance with the prior art.

Further, the supporting member 20 is positioned on the opposite side of the heater 5 from the spring contacts 161*r* and 162*r*, and backs up the heater 5 against the contact pressure generated by the spring contacts 161*r* and 162*r*.

Therefore, this embodiment has not only the effect which the third embodiment has, but also, is smaller in the amount of the shearing stress to which the heater 5 is subjected by the contact pressure generated by the spring contacts 161*f*, 162*f*, 161*r* and 162*r*. Therefore, this embodiment makes it possible to reduce the heater 5 in thickness.

<Embodiment 5>

Next, the fifth embodiment of the present invention is described. The heater 200 in this embodiment is provided with three heat generating members 201, and three power supply lines. Thus, the three heat generating members 201 connected to the three power supply lines, one for one, can be independently driven from each other. Further, each of the two connectors in this embodiment has two terminals (which are similar to the one shown in FIG. 13), which are in the housing of the connector.

Referring to FIG. 22(*a*), the front surface of the heater 5 is provided with two heat generation lines (heat generating members 201*a* and 201*b*), and the back surface of the heater is provided with one heat generation line (heat generating member 201*c*). The three heat generating members are different in heat generation amount distribution. More concretely, the front surface of the heater 5 are provided with two heat generating members 201*a* and 201*b*, which are in parallel to each other and extend in the lengthwise direction of the heater 5. The heat generation amount distribution of the heat generating member 201*a* is such that the closer it is to the center of the heat generating member 201*a*, the greater the amount by which heat is generated by the heat generating member 201*a*, whereas the heat generation distribution of the heat generating member 201*b* is such that the farther it is from the lengthwise center of the heat generating member 201*b*, the greater the amount by which heat is generated by the heat generating member 201*b*. The heat generation amount distribution of the heat generating member 201*c* is similar to that of the heat generating member 201*a*, that is, the closer to the lengthwise center of the heat generating member 201*c*, the greater the amount by which heat is generated by the heat generating member 201*c*. However, the heat generating member 201*c* is shorter than the heat generating member 201*a*, as shown in FIG. 22(*a*). These heat generating members are integrated with an electric power supply circuit as shown in FIG. 22(*e*). Thus, the heater 5 is changed in heat distribution by controlling switches 240*a*-240*c*. That is, the heater 5 can be changed in heat distribution so that the heat distribution of the heater 5 matches recording medium size, for example.

Referring to FIG. 22, the heater 200 is provided with five electrodes 210*a*-210*e*. Each of these electrodes is connected to a connector. The heating unit 2 in this embodiment is structured so that the circuit shown in FIG. 22(*e*) can be completed simply by connecting two connectors (230A and 230B) to the heater 5. The housing of the connector 230A contains two terminals which are similar to those shown in FIG. 13. That is, the heating unit 2 in this embodiment has four terminals (220*a*-220*c*). However, it is only in the case of the terminal 220*a* that all the spring contacts come into contact with one of the electrodes of the heater 5 as shown FIG. 22(*c*); the portions of the heater 5, which correspond in position to the other terminals 220 (220*b*, 220*c* and 220*e*) than the terminal 220*a*, one for one, have an electrode on only the front or back surface.

The four terminals 220*a*-220*e* are the same in shape. That is, the two connectors 230A and 230B in this embodiment are designed to be connected to the lengthwise ends of a two-sided heater, one for one, and yet, are the same in structure. That is, this connector design can reduces the connectors 230A and 230B in cost. Further, they can be further reduced in cost by being made the same in the shape of their housings 230A and 230B.

The connector terminals in this embodiment are practically the same in structure as the one shown in FIG. 13. Therefore, they can assure that a proper amount of contact pressure is generated and maintained between their spring contacts and the corresponding electrodes of the heater.

<Embodiment 6>

Figure 23:
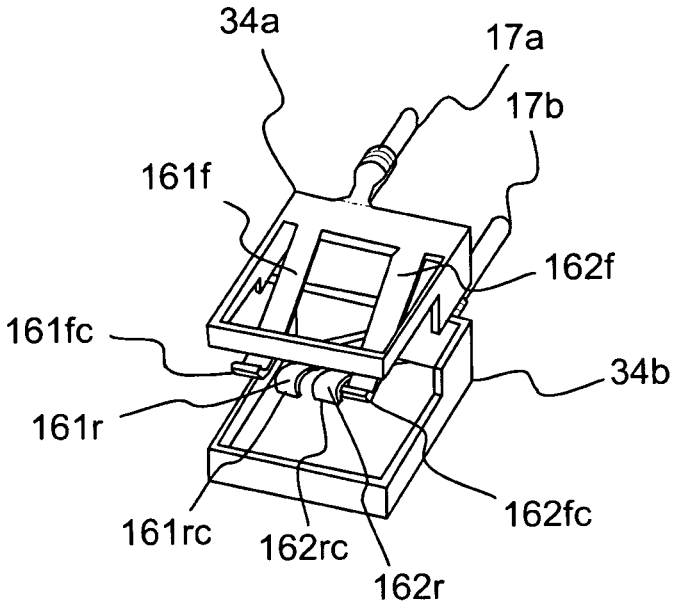
FIG. 23 is a perspective view of the connector terminal in the sixth embodiment.
Figure 24A:
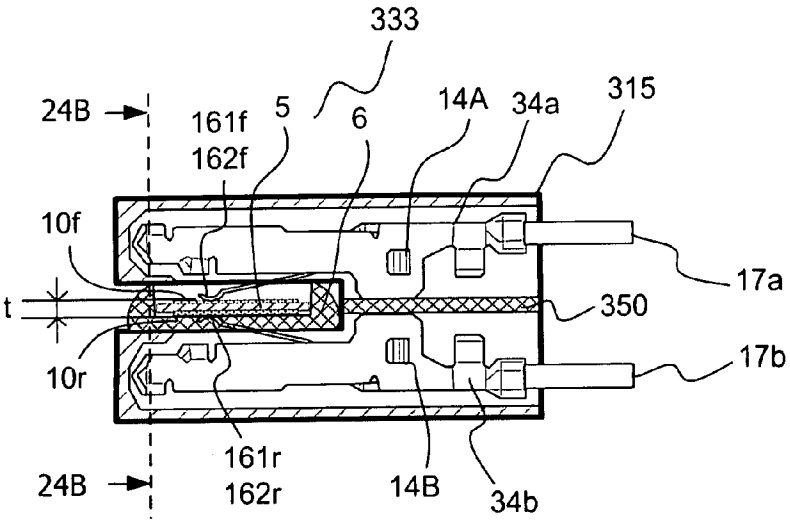
FIGS. 24A, 24B, and 24C are drawings of the connector in the sixth embodiment.
Figure 24C:
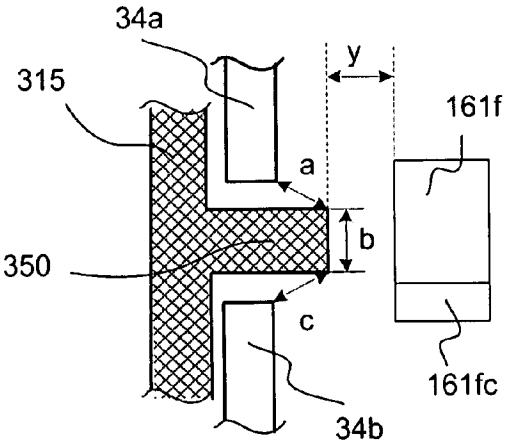
Figure 24B:
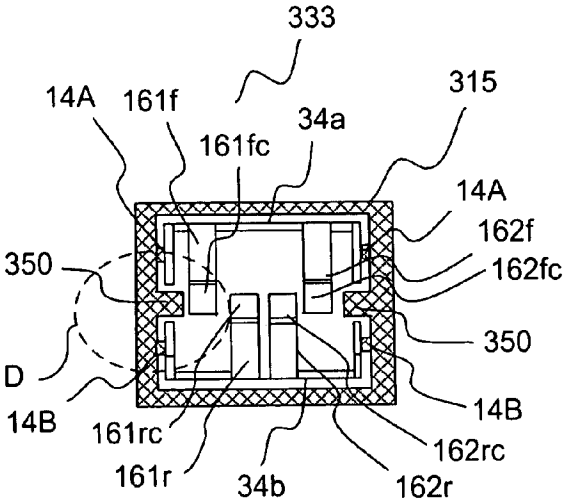

Next, referring to FIGS. 23 and 24, the sixth embodiment of the present invention is described. This embodiment is different from the preceding embodiments in that unlike the connectors in the preceding embodiments, the connector 333 in this embodiment has two terminals 34*a* and 34*b* which are electrically independent from each other, and the spring contacts of which are in the top and bottom portions of the connector housing.

FIG. 23 is a perspective view of the connector terminal 34 in this embodiment. The connector terminal 34 has two sub-terminals 34*a* and 34*b*. The sub-terminal 34*a* has two spring contacts 161*f* and 162*f*, and is in connection to a lead 17*a*. The sub-terminal 34*b* has two spring contacts 161*r* and 162*r*, and is in connection to a lead 17*b*. "161*fc*, 162*fc*, 161*rc* and 162*rc*" stand for the points of contact of the spring contacts, one for one.

FIG. 24(*a*) shows the state of the combination of the lengthwise end portion of the heating unit 2 after the attachment of the connector 333 to the heater holder 6 which holds the heater 5. FIG. 24(*b*) a sectional view of the connector 333, at a plane (b)-(b) in FIG. 24(*a*), after the disengagement of the connector 333 from the heater. "t" stands for the thickness of the heater 5. The connector sub-terminals 34*a* and 34*b* are solidly attached to terminal anchorages 14A and 14B, respectively, with which the connector housing 315 is provided. Referring to FIG. 24(*b*), when the connector 333 is not in engagement with the heater 5, the spring contacts 161*f* and 162*f* of the connector sub-terminal 34*a*, and the spring contacts 161*r* and 162*r* of the connector sub-terminal 34*b*, overlap as seen from the direction perpendicular to the direction in which their points of contact are displaced.

The connector in this embodiment also can ensure that a proper amount of contact pressure is generated and maintained between the point of contact of each spring contact and the corresponding electrode of the heater, regardless of the thickness t of the heater 5.

By the way, a substantial distance is sometimes required between the top and bottom terminals when the two terminals are differently used in terms of polarity. The method for providing a proper amount of distance between the top and bottom terminals is as follows:

In the case of this embodiment, a pair of insulating projections 350 are provided in the housing 315. The insulating projections 350 are also given the function of guiding the connector sub-terminals 34*a* and 34*b* when the sub-terminals 34*a* and 34*b* are fitted into the housing 315. Referring to FIG. 24(*b*), the insulating projections 350 are positioned so that they will be between the connector sub-terminals 34*a* and 34*b* after the fitting of the sub-terminals 34*a* and 34*b* into the housing 315. The housing 315 is structured so that the insulating projections 350 project toward the center of the housing 315.

FIG. 24(*c*) is an enlarged view of the area of FIG. 24(*b*), which is encircled by a dotted line D. There is a clearance y between the top end of the insulating projection 350 and spring contact 161*f*, which prevents the top end from coming into contact with the spring contact 161*f*. The distance provided between the connector sub-terminals 34*a* and 34*b* to insulate them from each other can be expressed as (a+b+c) in FIG. 24(*c*). Thus, a satisfactory amount of insulation distance can be provided by structuring the connector so that Inequality (insulation distance<(a+b+c) is satisfied.

While the present invention has been described with reference to the exemplary embodiments, it is not to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 108115/2012 and 066154/2013 filed May 10, 2012 and Mar. 27, 2013, respectively, which are hereby incorporated by reference.

What is claimed is:

1. An image fixing apparatus for heating and fixing an unfixed image formed on a recording material, comprising:

a heater including a substrate, a first electrode provided on one side of said substrate and a second electrode provided on the other side of the substrate with respect to a direction of thickness of the substrate; and a connector, connected with said heater, configured to supply electric power, said connector including an electrically insulative housing, and a contact terminal provided inside said housing and having a first spring contact contacted to said first electrode and a second spring contact contacted to said second electrode, wherein said first spring contact and said second spring contact are disposed at positions different as seen in a direction perpendicular to a surface of said substrate, wherein said first spring contact and said second spring contact overlap with each other in an urging direction of the spring contacts, in a state that the connector is removed from said heater, and wherein in the state that the connector is removed from said heater, the distance between the point on said first spring contact to contact said first electrode and the point on said second spring contact to contact said second electrode is larger than the thickness of any one of said first and second spring contacts.

2. An apparatus according to claim 1, wherein said first spring contact is provided at each of two positions which are the same with respect to a mounting direction of said connector so as to comprise two first spring contacts, and said two first spring contacts are provided at symmetrical positions with respect to a central line of said contact terminal with respect to a direction perpendicular to the mounting direction, and wherein said second spring contact is provided at each of two positions which are the same with respect to the mounting direction so as to comprise two second spring contacts, and said two second spring contacts are provided at symmetrical positions with respect to the central line.

3. An apparatus according to claim 1, further comprising an endless belt configured to be heated by said heater, and wherein the unfixed image on the recording material is heated through said endless belt.

4. An electrical connector for electric power supply, said connector comprising:

an electrically insulative housing; and a contact terminal provided inside said housing and including a first spring contact configured to contact a first electrode provided on one side of a heater substrate and a second spring contact configured to contact a second electrode provided on the other side of the substrate with respect to a direction of thickness of the substrate, wherein said first spring contact and said second spring contact are disposed at positions different from each other as seen in a direction perpendicular to a surface of said substrate, wherein said first spring contact and said second spring contact overlap with each other in an urging direction of the spring contacts, in a state that the connector is removed from said heater, and wherein in the state that connector is removed from said heater, the distance between the point on said first spring contact to contact said first electrode and the point on said second spring contact to contact said second electrode is larger than the thickness of said first spring contact.

5. A connector according to claim 4, wherein said first spring contact is provided at each of two positions which are the same with respect to a mounting direction of said connector so as to comprise two first spring contacts, and said two first spring contacts are provided at symmetrical positions with respect to a central line of said contact terminal with respect to a direction perpendicular to the mounting direction, and wherein said second spring contact is provided at each of two positions which are the same with respect to the mounting direction so as to comprise two second spring contacts, and said two second spring contacts are provided at symmetrical positions with respect to the central line.

6. An image fixing apparatus for heating and fixing an unfixed image formed on a recording material, comprising:

a heater including a substrate, a first electrode provided on one side of said substrate and a second electrode provided on the other side with respect to a direction of thickness of the substrate; and a connector, connected with said heater, configured to supply AC power, said connector including an electrically insulative housing, a first contact terminal provided inside said housing and having a first spring contact configured to contact said first electrode, and a second contact terminal provided inside said housing and having a second spring contact configured to contact said second electrode wherein said first and second contact terminals are electrically independent from each other.

7. An apparatus according to claim 6, wherein said first contact terminal and said second contact terminal are connected to cables different from each other.

8. An apparatus according to claim 6, wherein said first spring contact and said second spring contact are disposed at the positions different from each other as seen in the direction perpendicular to a surface of said substrate.

9. An apparatus according to claim 6, wherein said first spring contact is provided at each of two positions which are the same with respect to a mounting direction of said connector so as to comprise two first spring contacts, and said first spring contacts are provided at symmetrical positions with respect to a central line of said contact terminal with respect to a direction perpendicular to the mounting direction, and wherein said second spring contact is provided at each of two positions which are the same with respect to the mounting direction so as to comprise two second spring contacts, and said second spring contacts are provided at symmetrical positions with respect to the central line.

10. An apparatus according to claim 6, wherein said first spring contact and said second spring contact overlap with each other in an urging direction of the spring contacts, in a state that connector is removed from said heater.

11. An apparatus according to claim 6, further comprising an endless belt configured to be heated by said heater, and wherein the unfixed image on the recording material is heated through said endless belt.

12. An electrical connector for AC power supply, said connector comprising:

electrically insulative housing; and a first contact terminal provided inside said housing and including a first spring contact configured to contact a first electrode provided on one side of a heater substrate; and a second contact terminal provided inside said housing and including a second spring contact configured to contact a second electrode provided on the other side of the heater substrate with respect to the direction of the thickness of the substrate, wherein said first and second contact terminals are electrically independent from each other.

13. A connector according to claim 12, wherein said first contact terminal and said second contact terminal are connected to cables different from each other.

14. A connector according to claim 12, wherein said first spring contact and said second spring contact are disposed at the positions different from each other as seen in the direction perpendicular to a surface of said substrate.

15. A connector according to claim 12, wherein said first spring contact is provided at each of two positions which are the same with respect to a mounting direction of said connector so as to comprise two first spring contacts, and said first spring contacts are provided at symmetrical positions with respect to a central line of said contact terminal with respect to a direction perpendicular to the mounting direction, and wherein said second spring contact is provided at each of two positions which are the same with respect to the mounting direction so as to comprise two second spring contacts, and said second spring contacts are provided at symmetrical positions with respect to the central line.

16. A connector according to claim 12, wherein said first spring contact and said second spring contact overlap with each other in an urging direction of the spring contacts.

* * * * *